US011643892B2

(12) United States Patent
Schultz, Jr. et al.

(10) Patent No.: US 11,643,892 B2
(45) Date of Patent: May 9, 2023

(54) WELLBORE APPARATUS FOR SETTING A DOWNHOLE TOOL

(71) Applicant: Weatherford Technology Holdings, LLC, Houston, TX (US)

(72) Inventors: William Allen Schultz, Jr., Cypress, TX (US); David W. Teale, Spring, TX (US); Richard C. Davis, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/580,028

(22) Filed: Jan. 20, 2022

(65) Prior Publication Data

US 2022/0145711 A1 May 12, 2022

Related U.S. Application Data

(62) Division of application No. 16/270,426, filed on Feb. 7, 2019, now Pat. No. 11,248,428.

(51) Int. Cl.

| | |
|---|---|
| ***E21B 23/01*** | (2006.01) |
| ***E21B 33/128*** | (2006.01) |
| ***E21B 33/129*** | (2006.01) |
| *E21B 29/00* | (2006.01) |

(52) U.S. Cl.

CPC ..... *E21B 23/01* (2013.01); *E21B 33/128* (2013.01); *E21B 33/1293* (2013.01); *E21B 29/005* (2013.01)

(58) Field of Classification Search

CPC .... E21B 23/01; E21B 33/128; E21B 33/1293; E21B 29/005

See application file for complete search history.

(56) References Cited

U.S. PATENT DOCUMENTS

| | | | |
|---|---|---|---|
| 3,963,081 | A | 6/1976 | Anderson et al. |
| 4,044,826 | A | 8/1977 | Crowe |
| 4,180,132 | A | 12/1979 | Young |
| 4,487,258 | A | 12/1984 | Jackson et al. |
| 4,550,781 | A | 11/1985 | Kagler, Jr. |

(Continued)

FOREIGN PATENT DOCUMENTS

| | | | |
|---|---|---|---|
| EP | 0216527 | A2 | 4/1987 |
| EP | 0504848 | A1 | 9/1992 |

(Continued)

OTHER PUBLICATIONS

United Kingdom Combined Search and Examination Report dated Apr. 7, 2020, for Application No. GB2001021.1.

(Continued)

*Primary Examiner* — Yong-Suk (Philip) Ro

(74) *Attorney, Agent, or Firm* — Cabello Hall Zinda, PLLC

(57) ABSTRACT

A method of separating a downhole tubular includes running a tool into a wellbore to a predetermined location on a work string and actuating flow actuated slips. The method also includes maintaining slips in a set position by providing a first upward force on the work string. The method further includes rotating the work string to separate an upper portion of the tubular from a lower portion using a cutter assembly disposed on the work string below the slips and pulling the upper portion of the tubing and the tool from the wellbore.

24 Claims, 22 Drawing Sheets

(56) References Cited

U.S. PATENT DOCUMENTS

| | | | | |
|---|---|---|---|---|
| 4,669,538 | A | 6/1987 | Szarka | |
| 5,101,895 | A | 4/1992 | Gilbert | |
| 5,103,903 | A | 4/1992 | Marks, II | |
| 6,056,049 | A | 5/2000 | Davis | |
| 6,357,528 | B1 | 3/2002 | Davis et al. | |
| 6,629,565 | B2 | 10/2003 | Harrell | |
| 7,426,964 | B2 | 9/2008 | Lynde et al. | |
| 7,757,754 | B2 | 7/2010 | McKay | |
| 8,403,038 | B2 | 3/2013 | Russell et al. | |
| 8,403,061 | B2 | 3/2013 | Russell et al. | |
| 8,527,100 | B2 | 9/2013 | Russell et al. | |
| 8,869,896 | B2 | 10/2014 | Crow et al. | |
| 8,881,818 | B2 | 11/2014 | Crow et al. | |
| 8,881,819 | B2 | 11/2014 | Crow et al. | |
| 8,893,791 | B2 | 11/2014 | Crow et al. | |
| 8,985,230 | B2 | 3/2015 | Crow et al. | |
| 9,022,117 | B2 | 5/2015 | Segura et al. | |
| 9,416,635 | B2 | 8/2016 | Hekelaar | |
| 9,428,980 | B2 | 8/2016 | Evans | |
| 9,464,496 | B2 | 10/2016 | O'Rourke et al. | |
| 9,790,764 | B2 | 10/2017 | Ezell | |
| 9,920,584 | B2 | 3/2018 | Pelto et al. | |
| 10,024,127 | B2 | 7/2018 | Plante et al. | |
| 10,041,322 | B2 | 8/2018 | Braddick | |
| 2009/0229832 | A1* | 9/2009 | King | E21B 33/1295 166/135 |
| 2016/0130901 | A1 | 5/2016 | Coronado et al. | |
| 2018/0216432 | A1 | 8/2018 | Nelson et al. | |

FOREIGN PATENT DOCUMENTS

| | | | |
|---|---|---|---|
| EP | 2662526 | A2 | 11/2013 |
| GB | 2210083 | A | 6/1989 |
| GB | 2568914 | A | 6/2019 |
| GB | 2573315 | A | 11/2019 |
| WO | 2011031164 | A1 | 3/2011 |
| WO | 2013133718 | A1 | 9/2013 |
| WO | 2017046613 | A1 | 3/2017 |
| WO | 2017182549 | A1 | 10/2017 |
| WO | 2018046907 | A1 | 3/2018 |
| WO | 2018069683 | A1 | 4/2018 |
| WO | 2018069685 | A2 | 4/2018 |
| WO | 2018083473 | A1 | 5/2018 |
| WO | 2018142122 | A1 | 8/2018 |
| WO | 2018142123 | A1 | 8/2018 |
| WO | 2018203063 | A1 | 11/2018 |
| WO | 2018211284 | A1 | 11/2018 |
| WO | 2020095043 | A1 | 5/2020 |

OTHER PUBLICATIONS

United Kingdom Search and Examination Report in related application GB22073523 dated Jun. 6, 2022.

* cited by examiner

WELLBORE APPARATUS FOR SETTING A DOWNHOLE TOOL

CROSS-REFERENCE TO RELATED APPLICATIONS

This Application is a Division of application Ser. No. 16/270,426, filed on Feb. 7, 2019, which application is incorporated herein by reference in its entirety.

BACKGROUND

Field

Embodiments described herein generally relate to a wellbore apparatus for setting a downhole tool. More particularly, the embodiments relate to an apparatus and methods for setting a packer downhole.

Description of the Related Art

Downhole operations are often accomplished with multiple tools on a single work string. Depending on the operation required, the tools are operated in a predetermined sequence. In some instances, it is necessary to ensure one tool does not operate prematurely. There is a need for a downhole mechanism to prevent inadvertent or premature operation of a tool. More specifically, there is a need to prevent inadvertent or premature setting of a downhole packer.

SUMMARY

The present disclosure generally relates to a locking system for a downhole tool comprising a first portion having a plurality of displaceable members, a second portion disposed around the first portion; a locked position wherein axial movement between the members is prevented; and an unlocked position wherein axial movement between the members is permitted. In one embodiment, the invention includes a downhole tool comprising a set of slips for maintaining the tool in an axial location in a wellbore. The slips are flow-actuated initially and then maintained in a set position due to a first upward force applied to the tool in the wellbore. A packer for sealing an annular area around the tool includes a locking system actuated by an additional upward force applied to the tool in the wellbore. In one embodiment, the tool is used in connection with a cutting tool to sever and remove a section of a tubular string lining the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure including a tool having a slip assembly and a packer assembly having a locking system to prevent inadvertent or premature setting of the packer.

Figure 1:
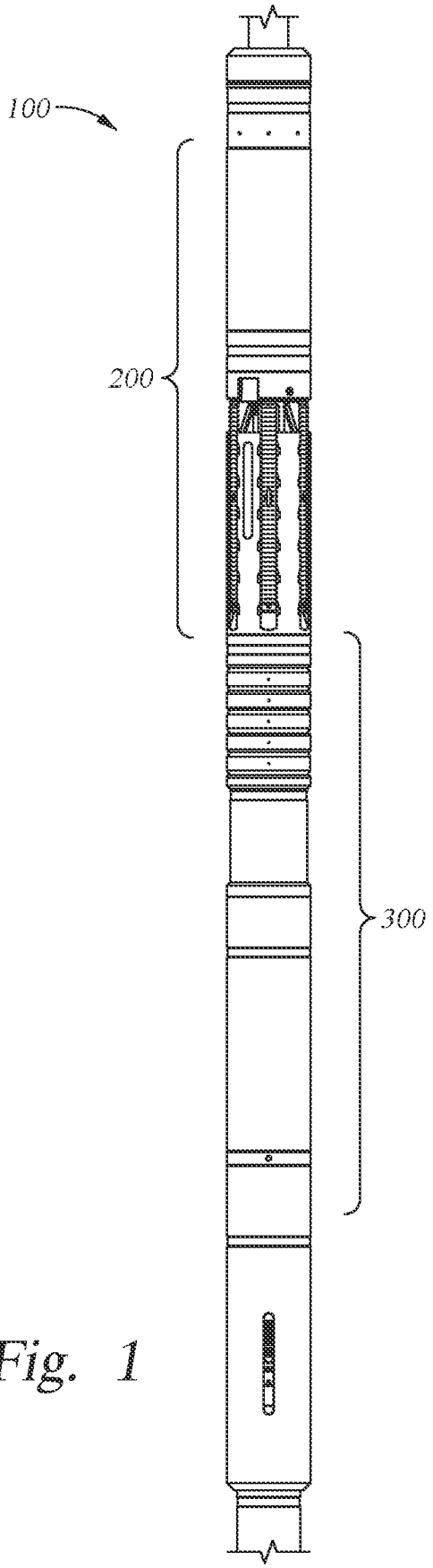
FIG. 1 is a front view of a tool according to one embodiment of the invention.
Figure 2:
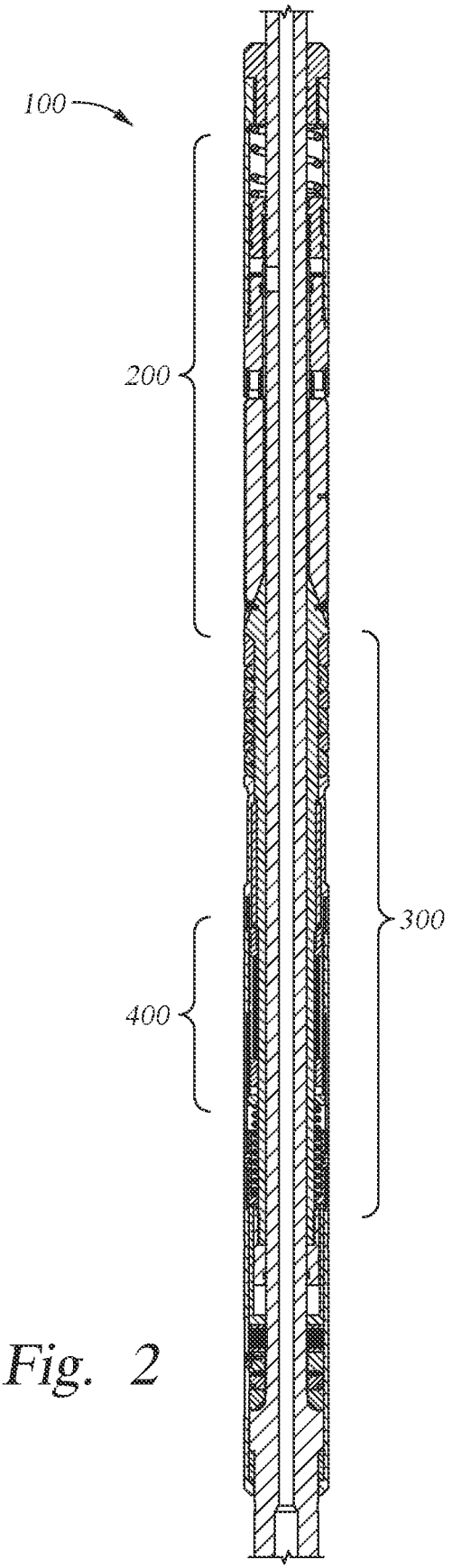
FIG. 2 is a section view of the tool of FIG. 1.
Figure 8:
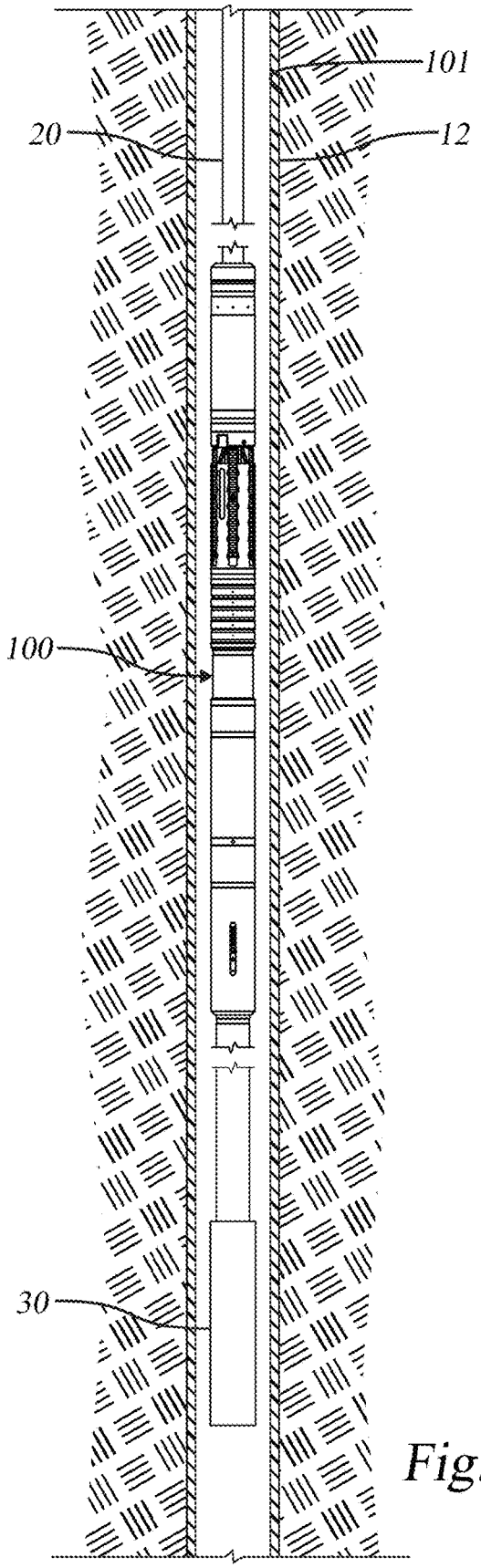
FIG. 8 shows the tool run into a wellbore on a work string with a cutting tool disposed on the string therebelow.
Figure 9:
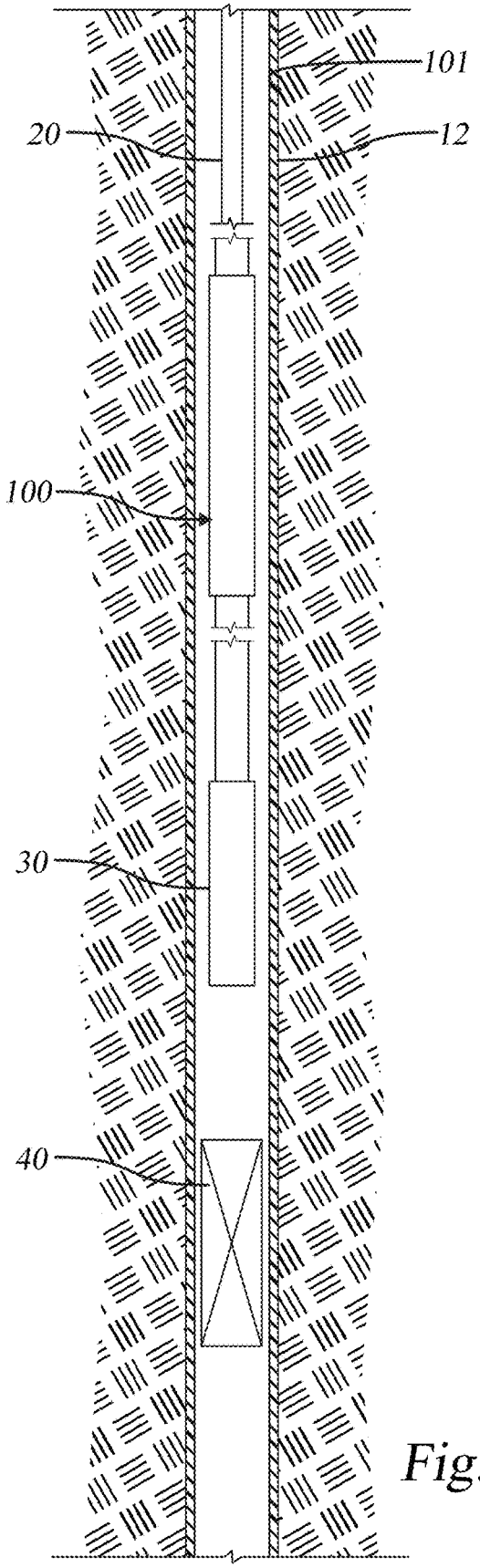
FIG. 9 shows another view of the tool run into a wellbore on a work string with a cutting tool disposed on the string therebelow.

FIG. 1 is a front view of a tool 100 according to one embodiment of the invention. The tool described herein is one that includes a slip assembly 200 and a packer assembly 300, with the packer having a locking system 400 that prevents operation of and setting of the packer until certain conditions are met. Embodiments as shown in FIGS. 8 and 9 also include a cutting tool 30 disposed below the tool 100 on the same work string 20. It will be understood however that any number of different tools could be utilized with the tool described herein and the locking system described in relation to the packer assembly 300 is of use on any number of different tools where inadvertent actuation is a potential problem. FIG. 2 is a section view of the tool 100 of FIG. 1.

Figure 3A:
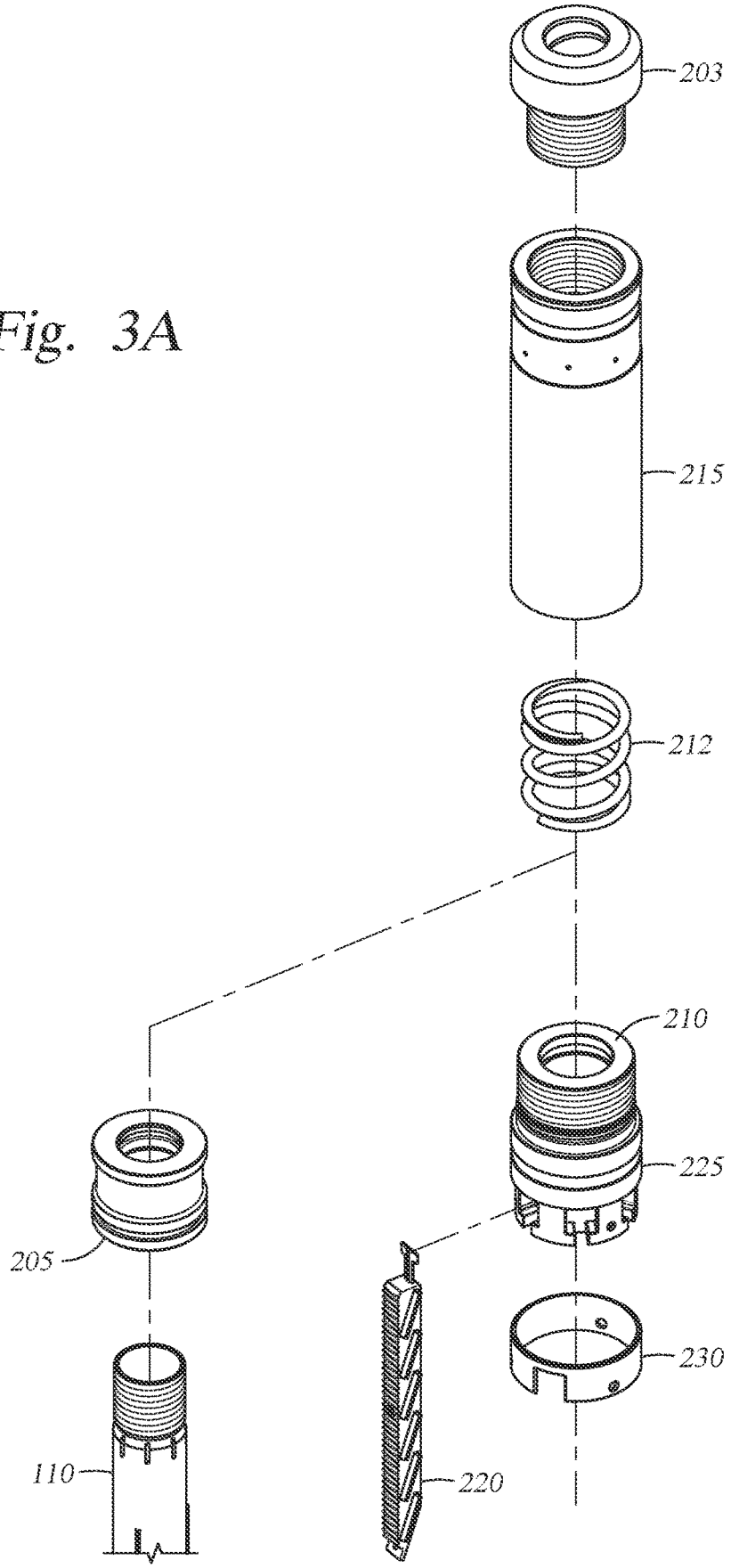
FIG. 3A is an exploded view showing different parts of the tool.
Figure 4A:
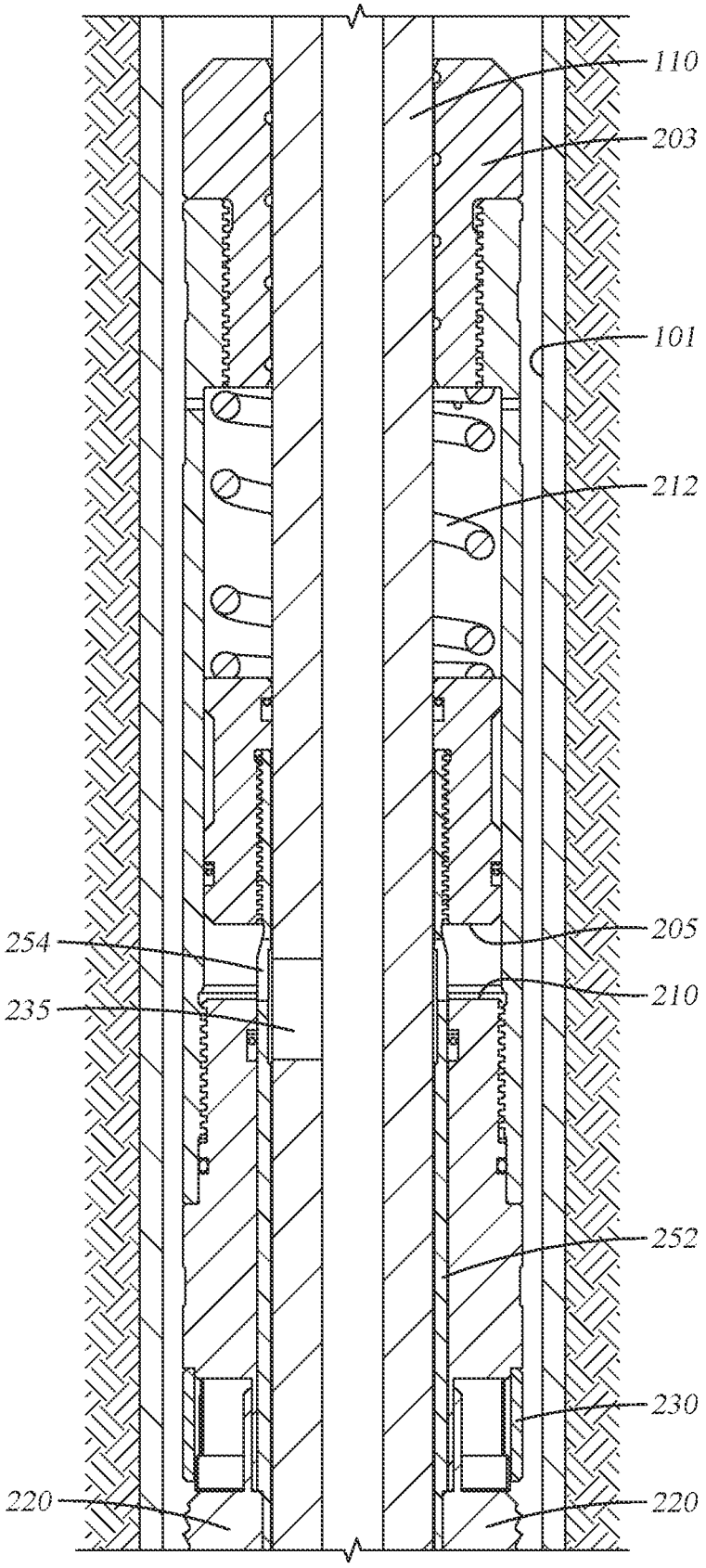
FIGS. 4A-D are section views showing the tool in a run-in positon in a wellbore, the tool having a slip assembly and a packer assembly.

FIG. 3A is an exploded view showing different parts of the tool 100. The portions illustrated generally refer to the slip assembly 200 visible in an assembled manner in FIGS. 4A, B. Included are a cap 203, an upper 205 and lower 210 piston surfaces as well as a spring 212 and spring housing 215 to bias the plurality of slips in a run-in and unset position. A slip housing 225 is shown as well as an exemplary slip 220 and slip retainer 230. The various parts of the slip assembly 200 are installed on a mandrel 110.

Figure 3B:
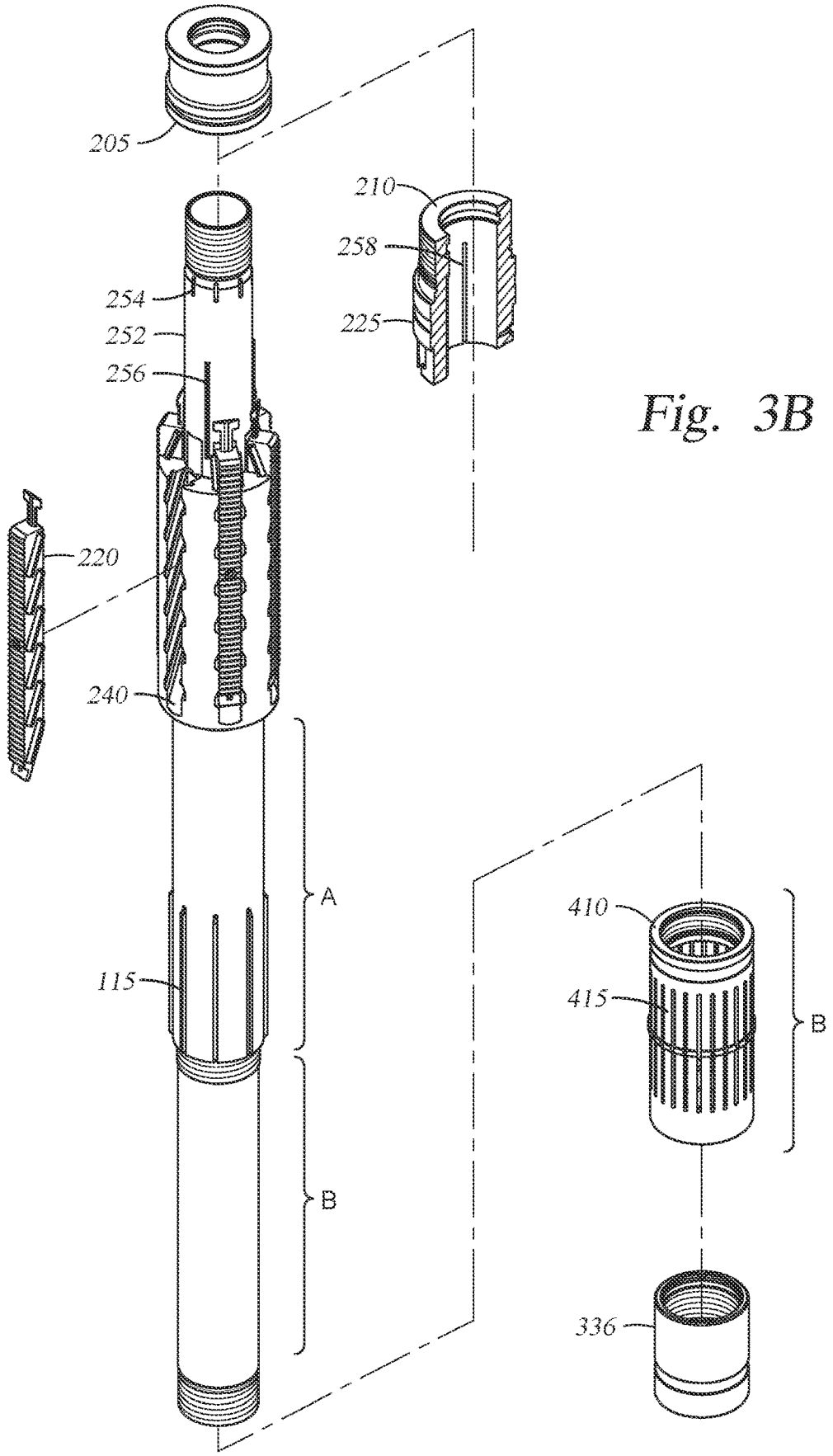
FIG. 3B is an exploded view showing different parts of the tool.

FIG. 3B is an exploded view showing the parts of the slip assembly 200 as well as a portion of the locking system 400 for the packer assembly 300. Areas of FIG. 3B labeled A and B correspond to similarly labeled areas of FIG. 3C. Visible is a housing for sub-assemblies 252 with anti-rotation keys 256 and ribs 115 disposed there upon. The keys interact with key slots 258 formed in piston body adjacent piston surface 210 and ribs 115 interact with slots 130 (FIG. 3D) to permit axial but not rotational movement. Fluid passageways 254 serve to provide a fluid path for fluid used to set the slip assembly 200. Also visible are portions of the slip assembly 200 with the slips 220 installed as well as the upper and lower piston bodies with piston surfaces 205, 210 formed thereon for flow-actuating the slips. Also shown are portions of the locking system 400 for the packer assembly 300 consisting of a collet sleeve 410 having displaceable collet fingers 415 and stop sleeve 336, the functions of which will be described herein.

Figure 3C:
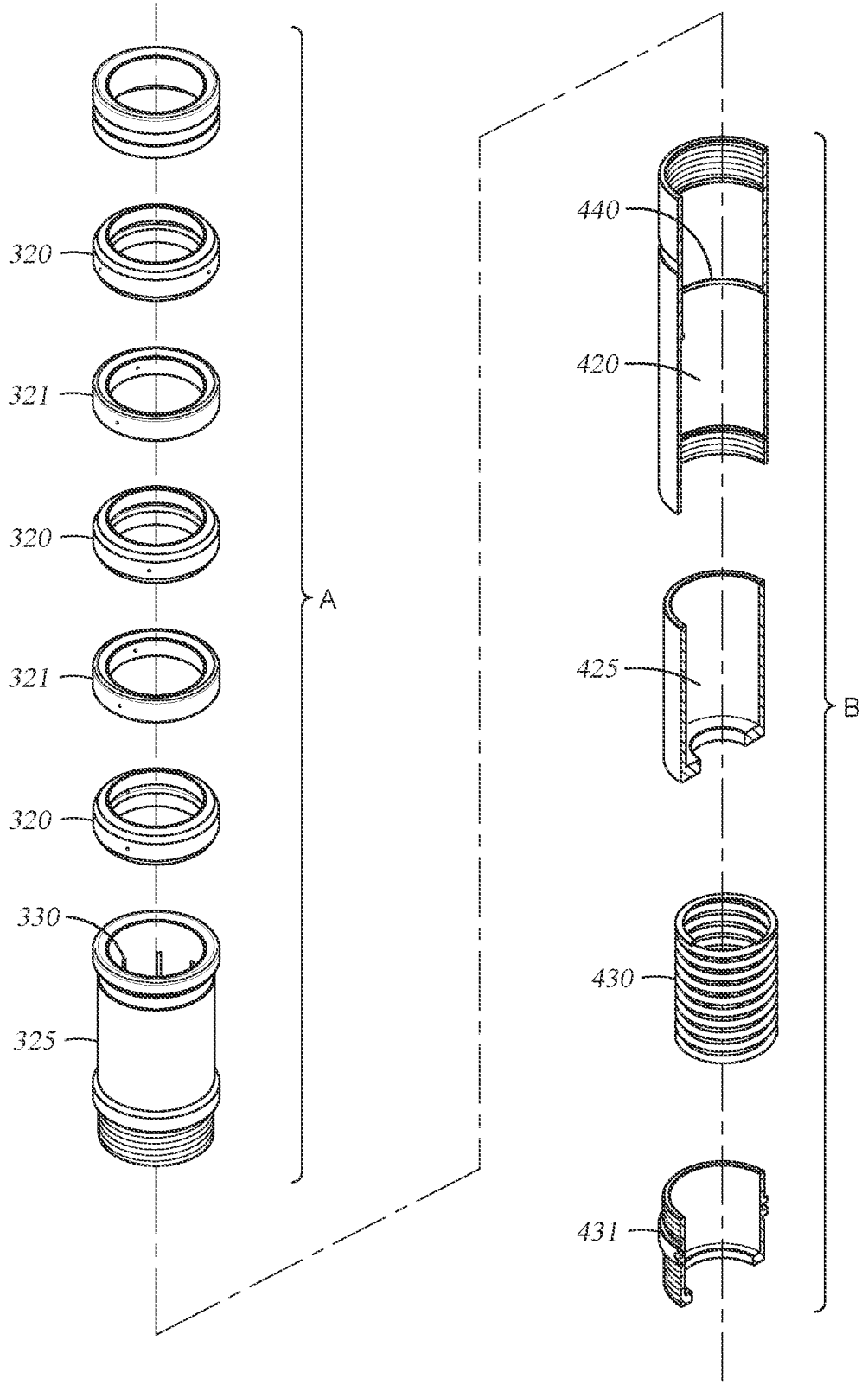
FIG. 3C is an exploded view showing different parts of the tool.

FIG. 3C is an exploded view showing different parts of the tool. On the left hand side of the tool are packer elements 320 separated by spacers 321 that correspond to area A of FIG. 3B and will be disposed on the mandrel 110 below the slip assembly 200 of FIG. 3B. A slot housing 325 includes slots 330 that correspond to the anti-rotation ribs 115 of FIG. 3B. On the right side of the Figure are additional portions of the locking system 400 for the packer including a collet housing 420 for housing the collet sleeve 410 of FIG. 3B as well as a spring loaded sleeve 425 and a spring 430 and spring housing 431 for urging the sleeve upwards into contact with the collet sleeve 410.

Figure 3D:
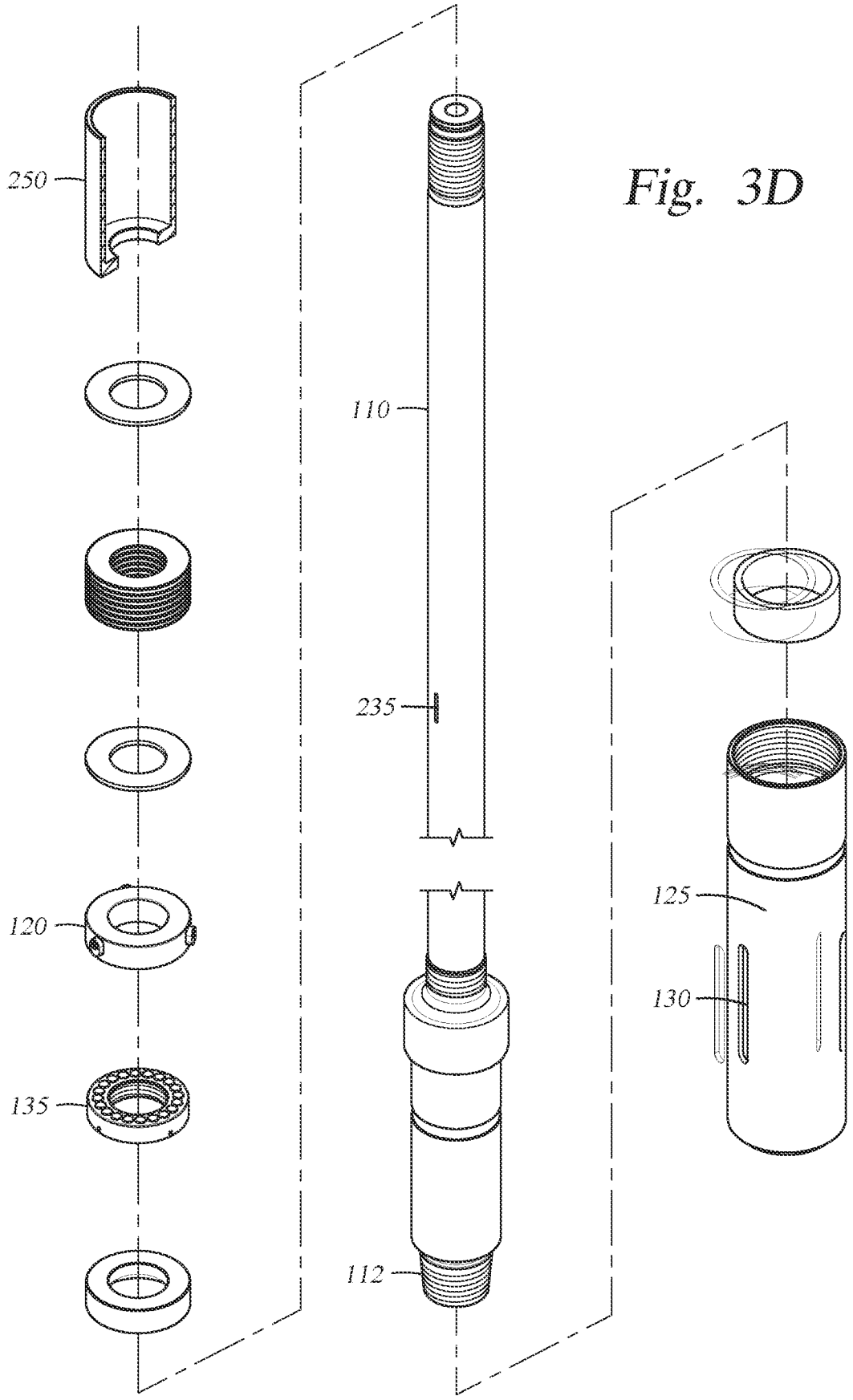
FIG. 3D is an exploded view showing different parts of the tool.

FIG. 3D is an exploded view showing different parts of the tool. In the center of the Figure is the mandrel 110 constructed and arranged to be rotatable in order to rotate another tool (not shown) disposed on the lower end of mandrel via threads 112. The mandrel includes radially disposed fluid slots 235 for the passage of fluid in order to set the slip assembly 200. On each side of the Figure are components, most of which are prevented from rotation by a keyed arrangement between a ring with lugs 120 that operates in conjunction with a sleeve 125 having mating vertical slots 130 permitting axial but not rotational movement between the components. A bearing member 135 facilitates the rotation of the mandrel 110 and other center portions of the assembly in relation to the outer portions.

Figure 4B:
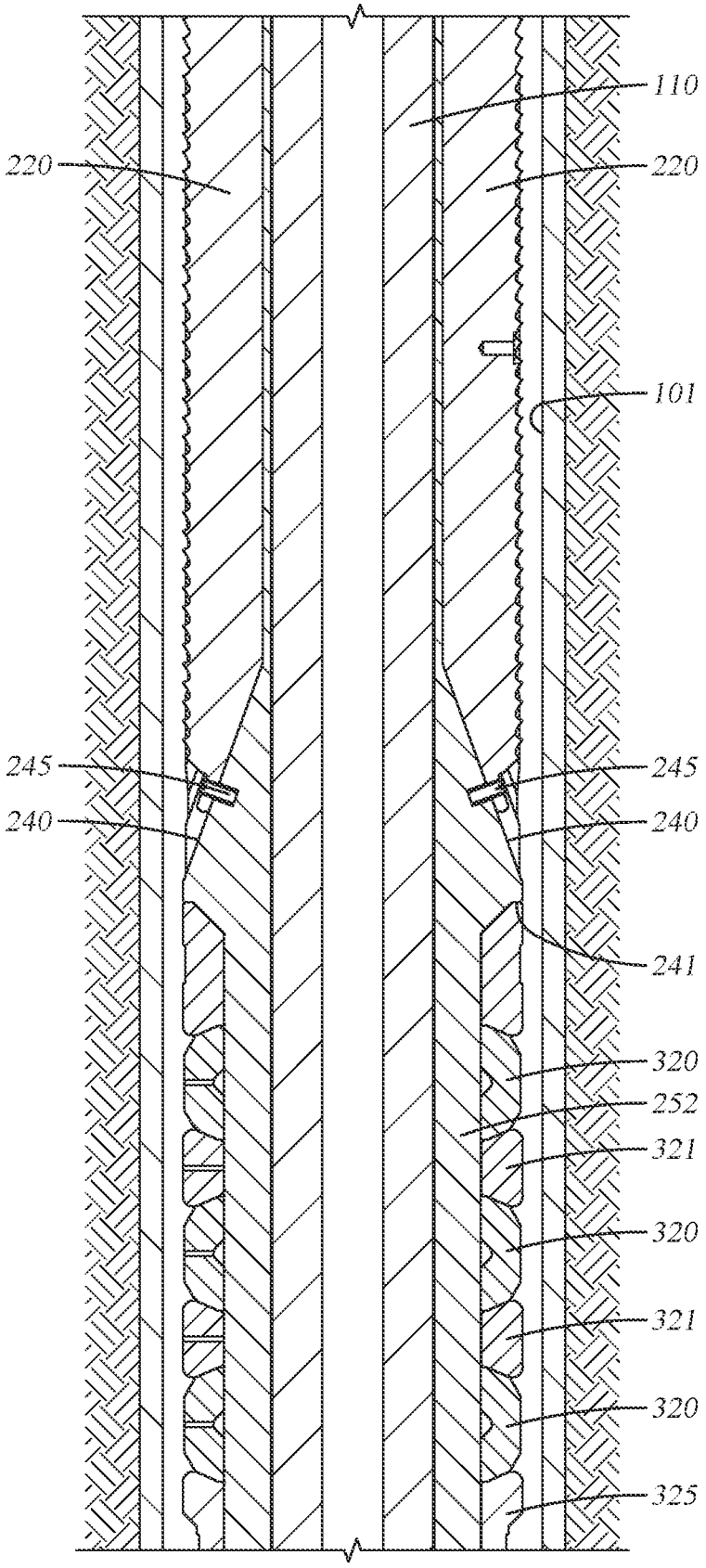

FIGS. 4A-D are section views showing the tool 100 in a run-in positon in a wellbore, the tool including the slip assembly 200 and packer assembly 300 with its locking system 400. In this document the term "wellbore wall" refers to an inside wall of a tubular that lines the earthen borehole. Portions of the slip assembly already introduced are visible in FIG. 4A including the cap 203, upper and lower piston surfaces 205, 210 and a port 235 providing a fluid path between an interior of the mandrel 110 and the two piston surfaces. The fluid path includes ports 235 formed in the mandrel 110 as well as fluid passageways 254 formed in the sub-assembly housing 252. FIG. 4B illustrates additional portions of the slip assembly 200 including the slips 220 and a conical shape 240 that serves to urge the slips outwards and into contact with the wellbore wall as they are set. Generally, the slip assembly includes a number of slips 220 constructed and arranged to be urged along the conically shaped member 240 and into a wedging relationship with the walls of the surrounding wellbore 101.

In the embodiment shown, the slips 220 are biased in an unset position by spring 212, the force of which must be overcome to move the cap/slip combination downwards in relation to the conical shape 240. The slips are further held in the run-in position by set screws 245 temporarily connecting the slip members to the conical shape 240. The slip assembly 200 is flow-actuated by pumping fluid through the work string (20; FIG. 8) upon which the tool 100 is mounted and run into the well. Port 235 (there are typically several radially spaced around the mandrel) located in a wall of the mandrel 110 permits fluid communication between the work string (20; FIG. 8) and the two piston surfaces 205, 210, one associated with the slip members and one associated with that part of the assembly on which the conical shape 240 is formed. Fluid pressure separates the two pistons and in doing so, overcomes the bias of the spring 212, causing the set screws 245 to fail and moves the slips 220 to a set position as shown in FIGS. 5A-D. The slips are thereafter retained in the set position due to an upward force applied to the mandrel 110 from the surface which creates a wedge-like condition between the conical shape 240, slips 220, and the wellbore wall 101.

Figure 4C:
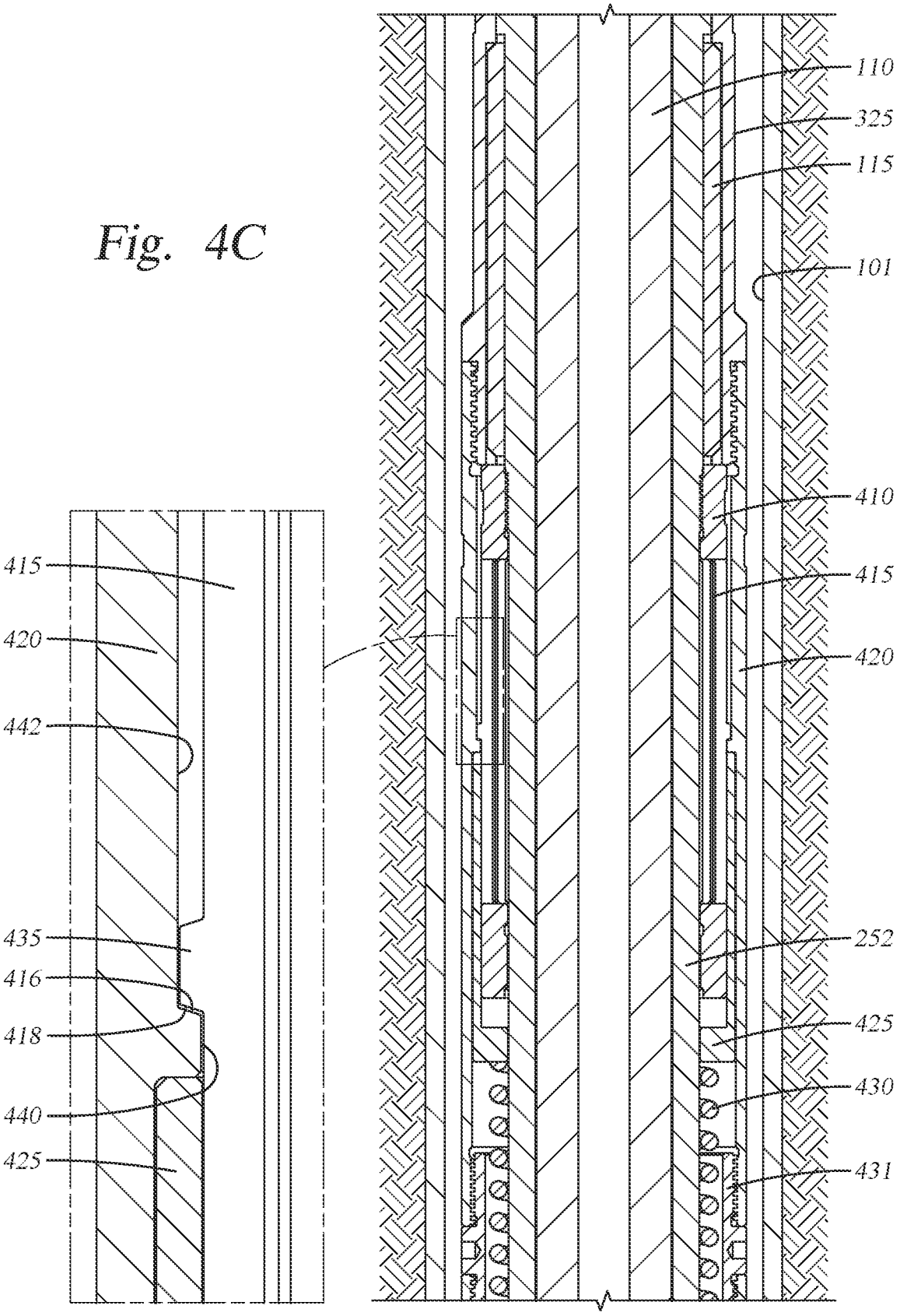
Figure 4D:
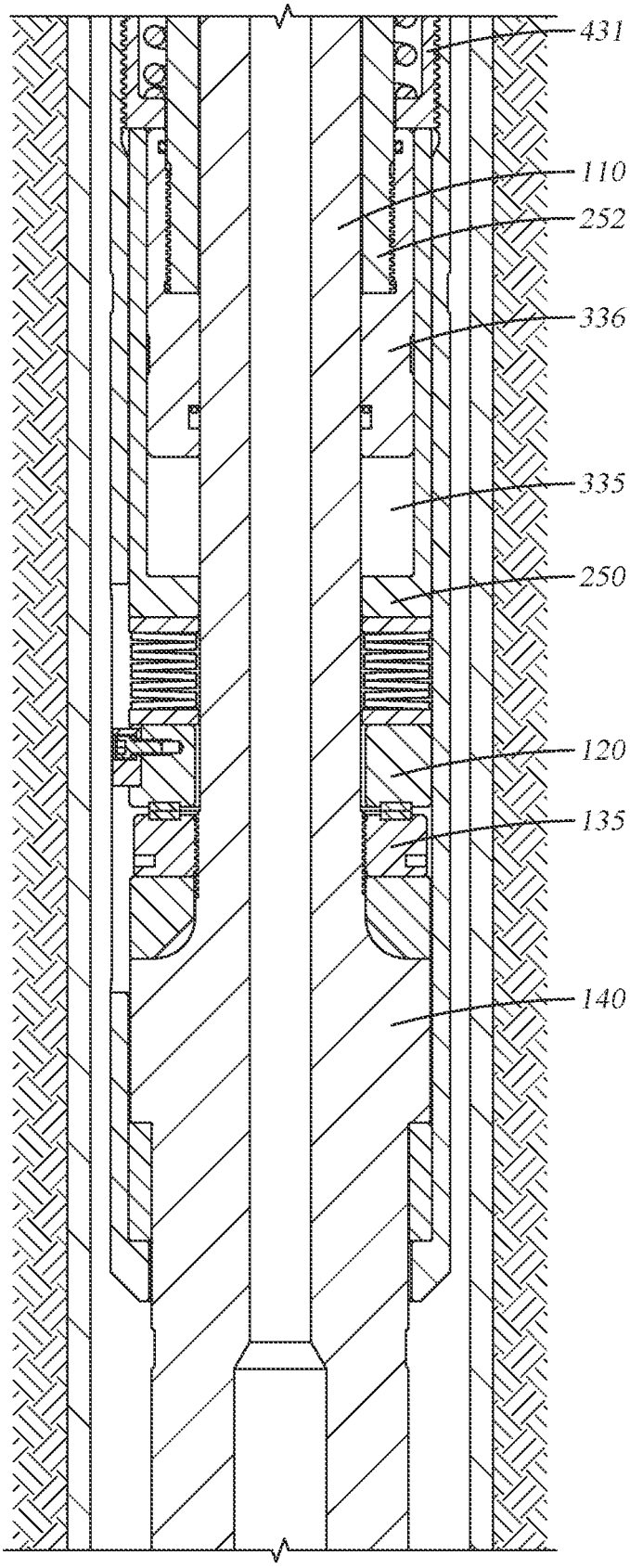
Figure 5A:
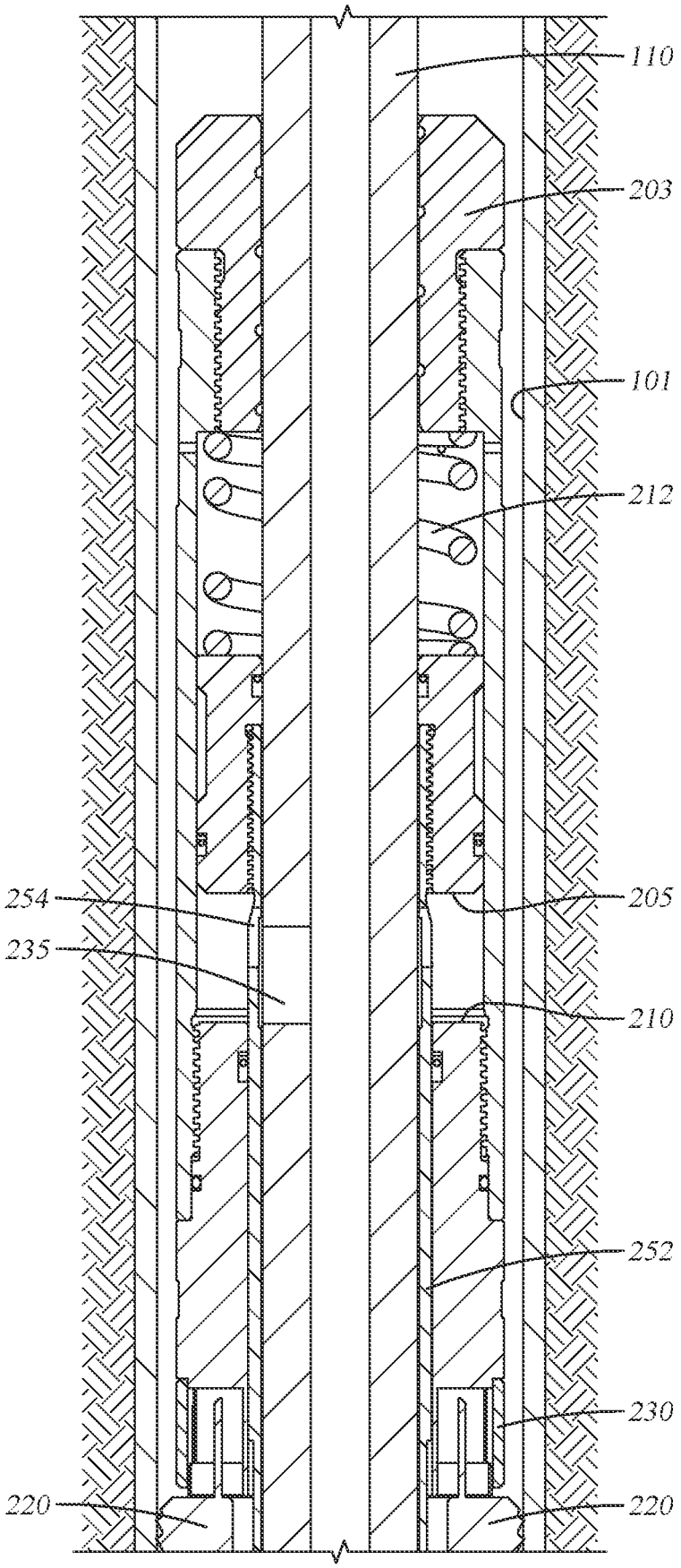
FIGS. 5A-D are section views showing the tool with slips of the slip assembly set in the wellbore and a locking system of the packer assembly in a locked position.
Figure 5B:
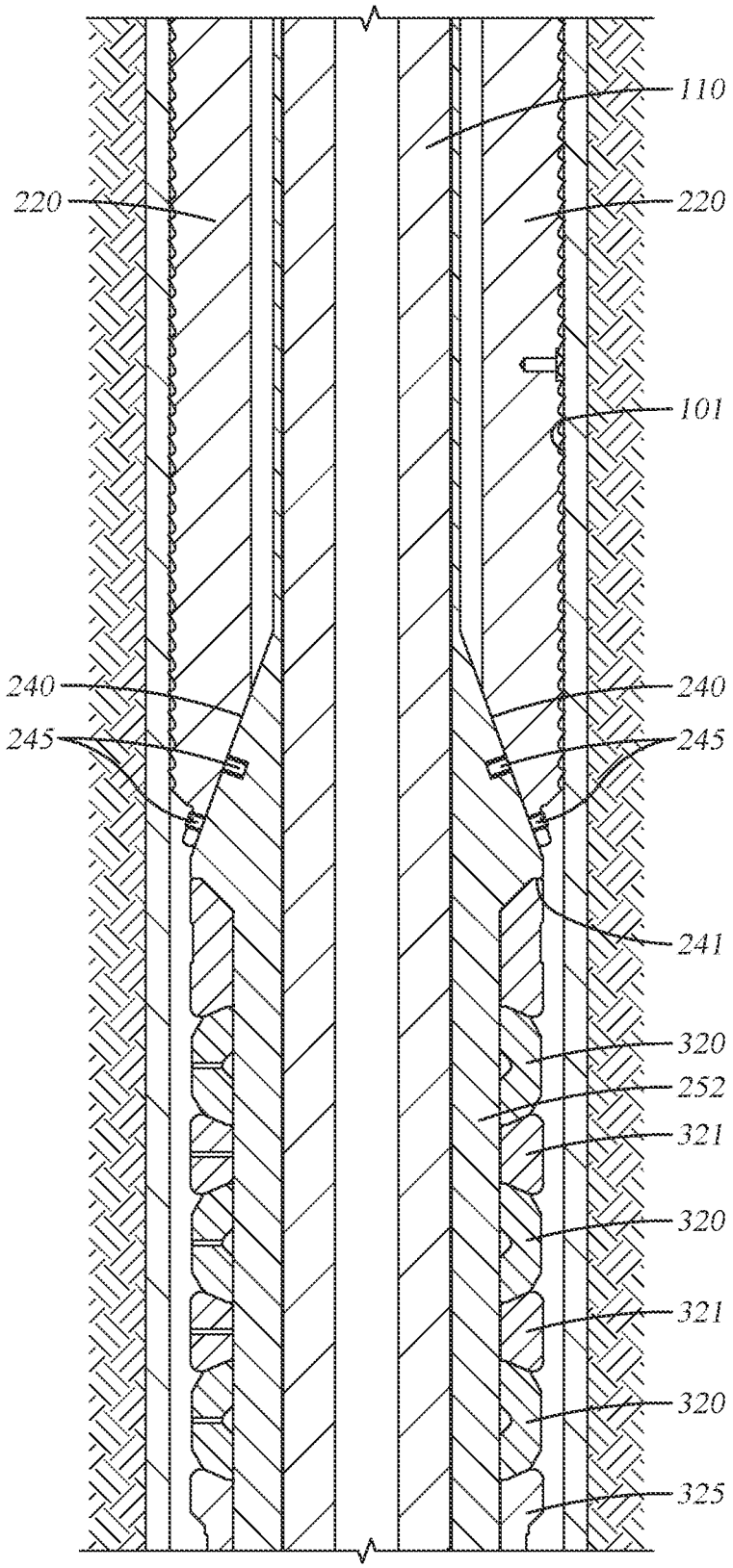
Figure 5C:
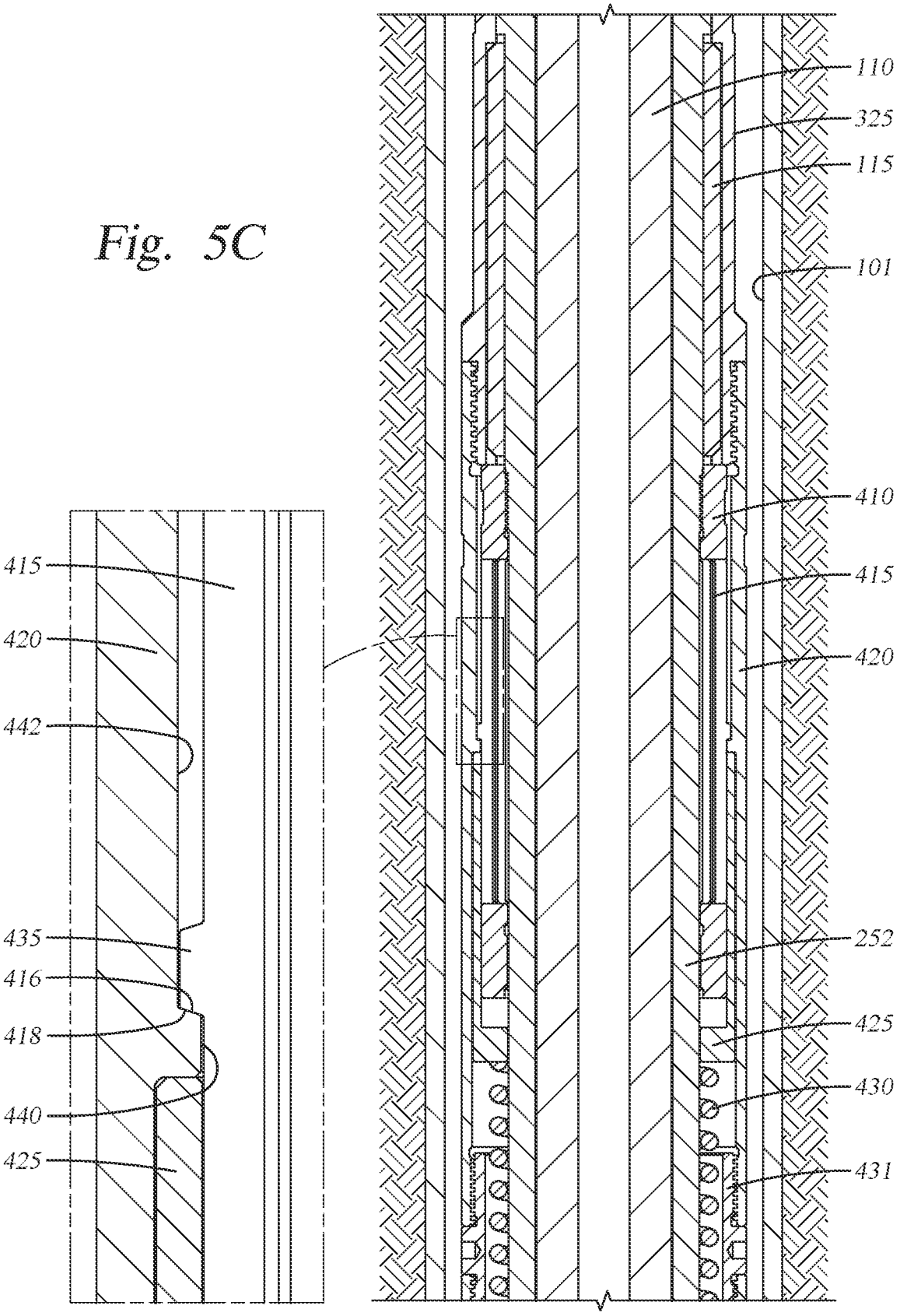
Figure 5D:
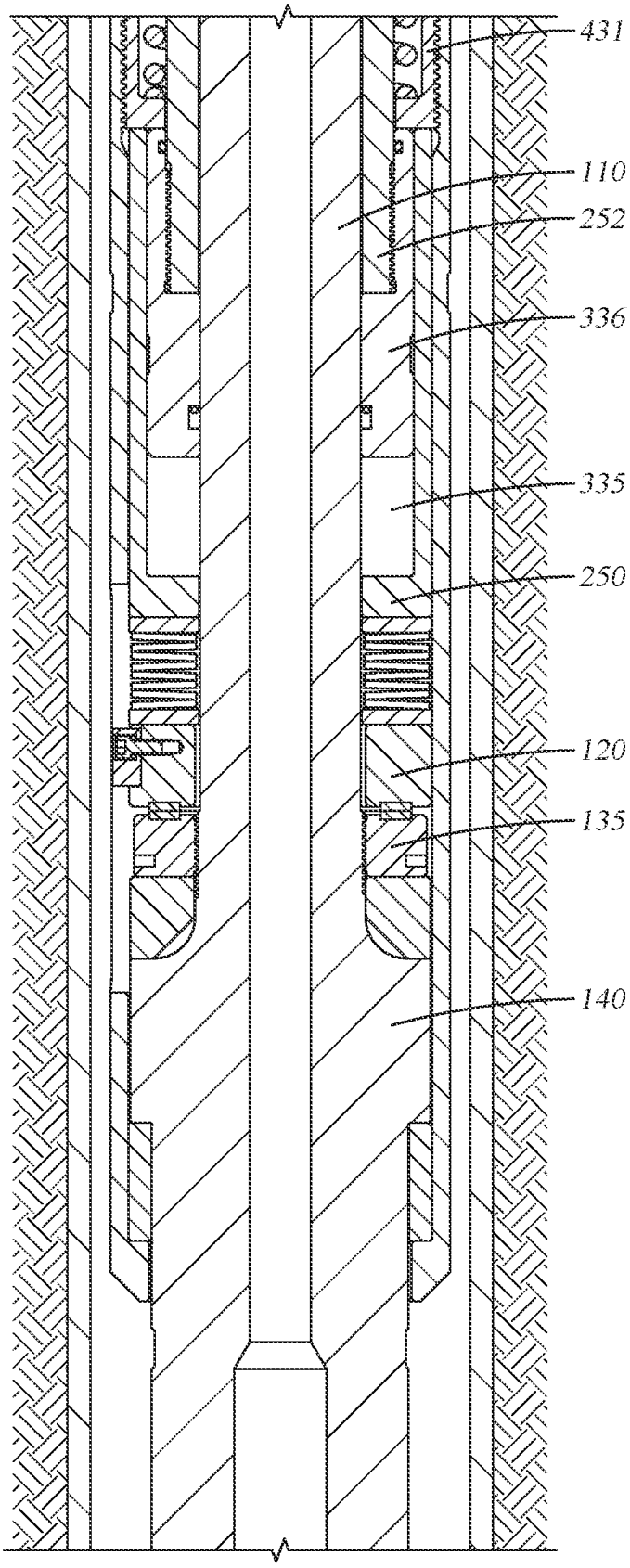

Shown primarily in FIGS. 4B-D is the packer assembly 300 with its locking system 400. The packer is unset. Shown in FIG. 4B are the packing elements 320 and spacers 321 of FIG. 3C, each of which is compressible. The elements are retained at an upper end by a downwardly facing shoulder of the conical shape 240 and at a lower end by an upward facing shoulder movable relative to the underside in order to compress the packer elements. As the slips are set in the wellbore, the packer assembly 300 remains in its original, unset position.

FIGS. 5A-D are section views showing the tool with slips of the slip assembly set in the wellbore and the locking system 400 of the packer retaining the packer in its unset position. Fluid pressure delivered through port 235 has moved lower piston 210 to a lower positon relative to the port and with it, the cap 203 which has compressed the biasing spring 212 that was biasing the slip assembly 200 in the run-in positon. As can be appreciated from FIG. 5B, the set screws 245 have failed and the slips 220 have moved down and out along the conical shape 240 and into contact with the walls of the wellbore 101. Although the slips 220 have been set, the packer assembly 300 remains in the unset position.

Figure 6A:
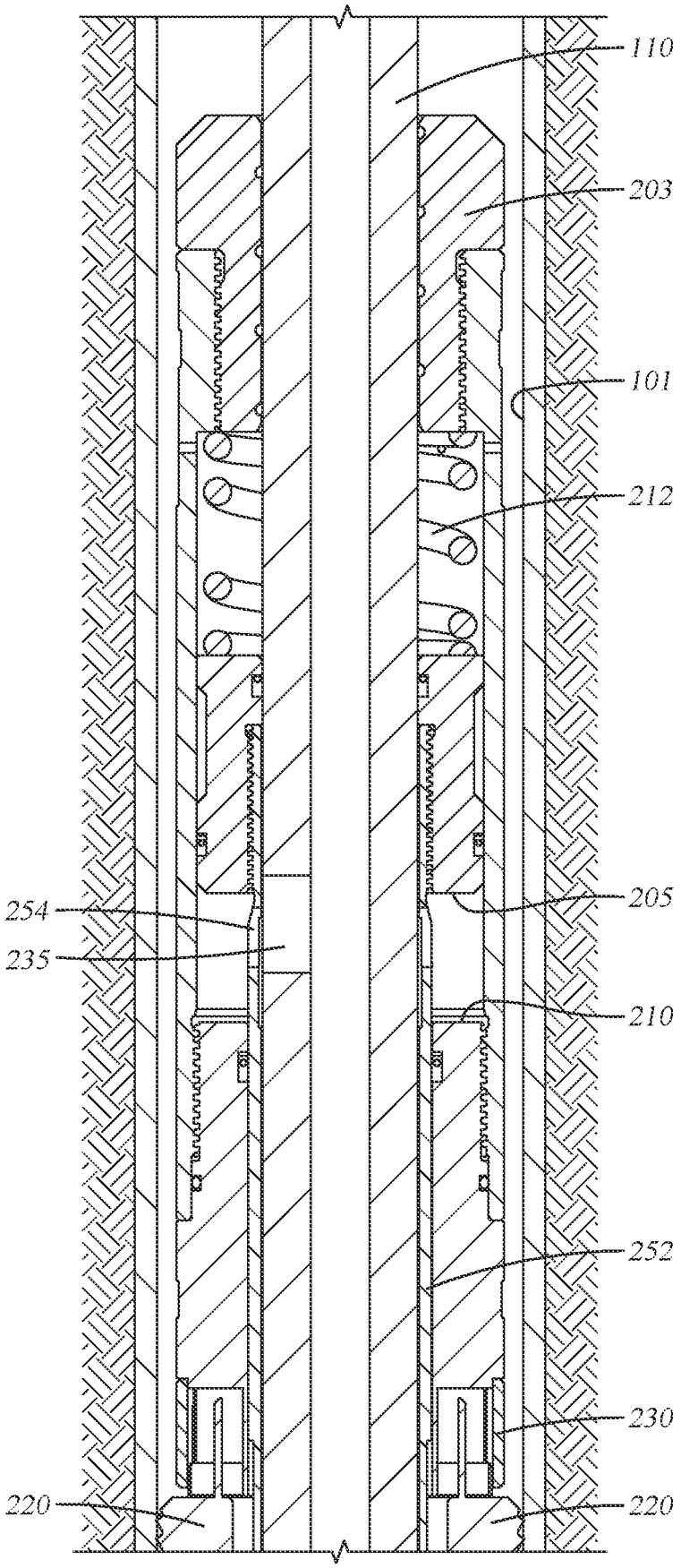
FIGS. 6A-D are section views showing the tool in the wellbore with the locking system of the packer in an unlocked position.
Figure 6B:
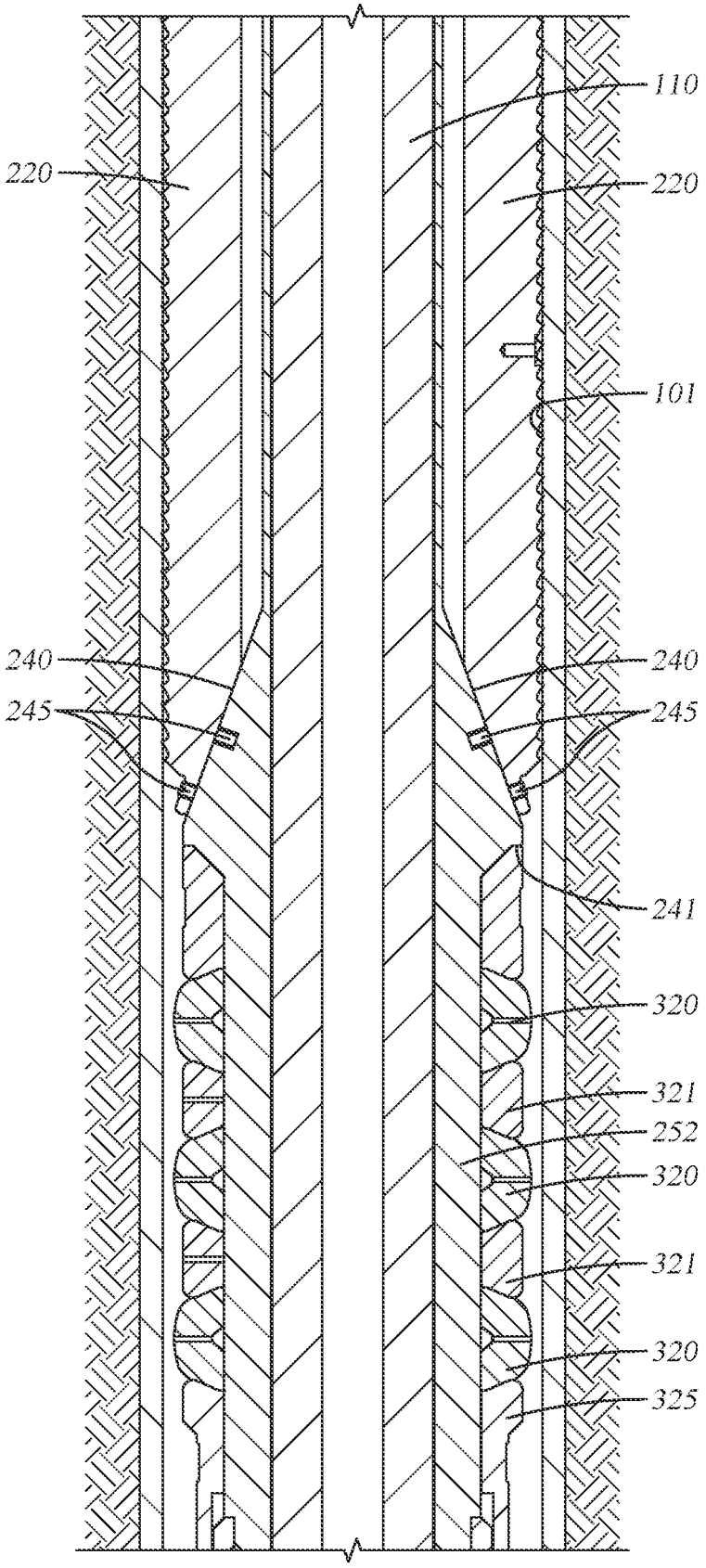
Figure 6C:
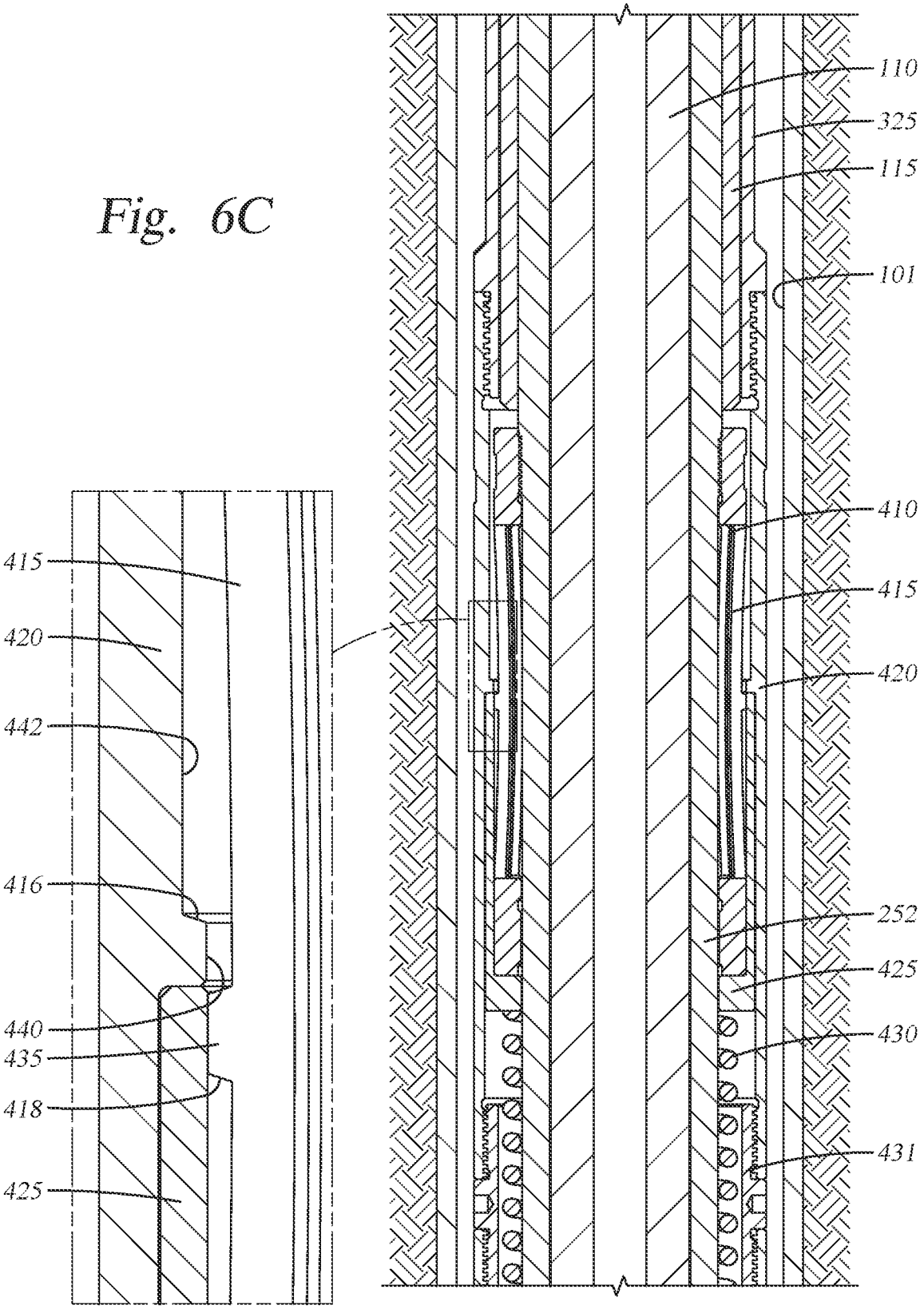
Figure 6D:
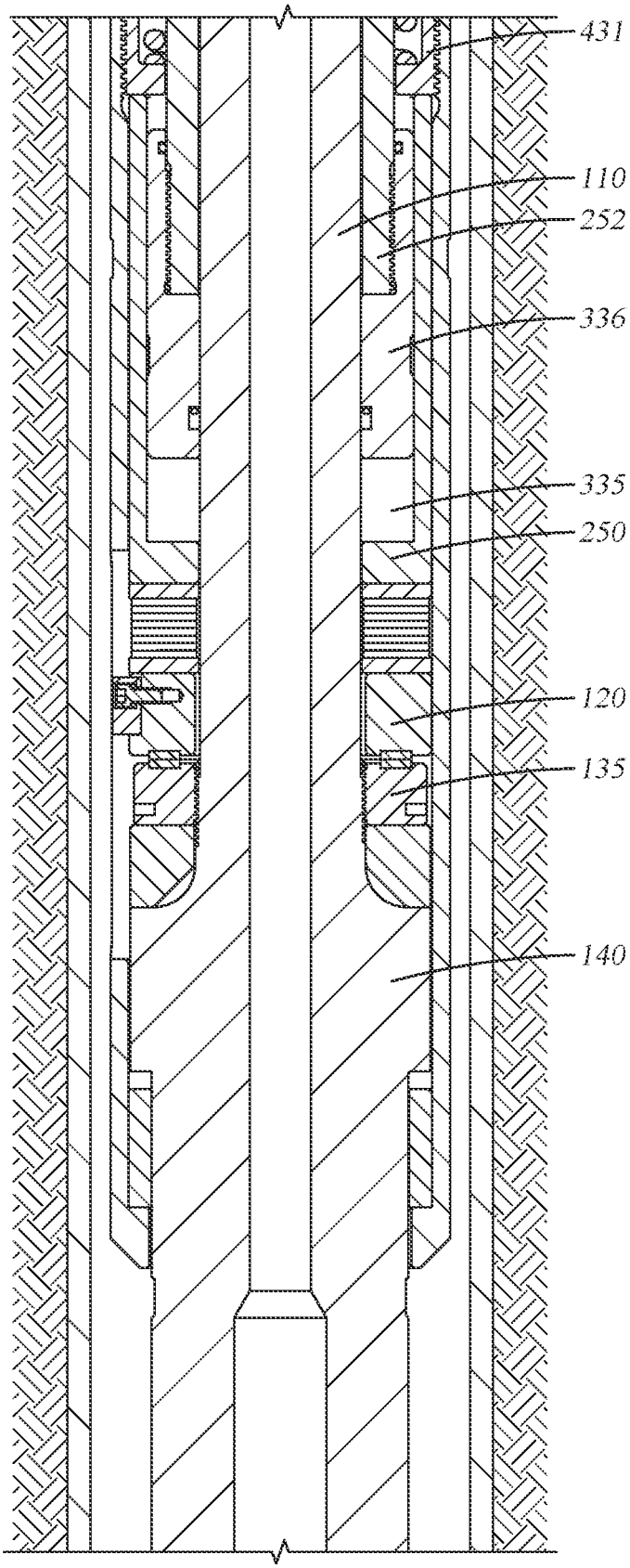
Figure 7A:
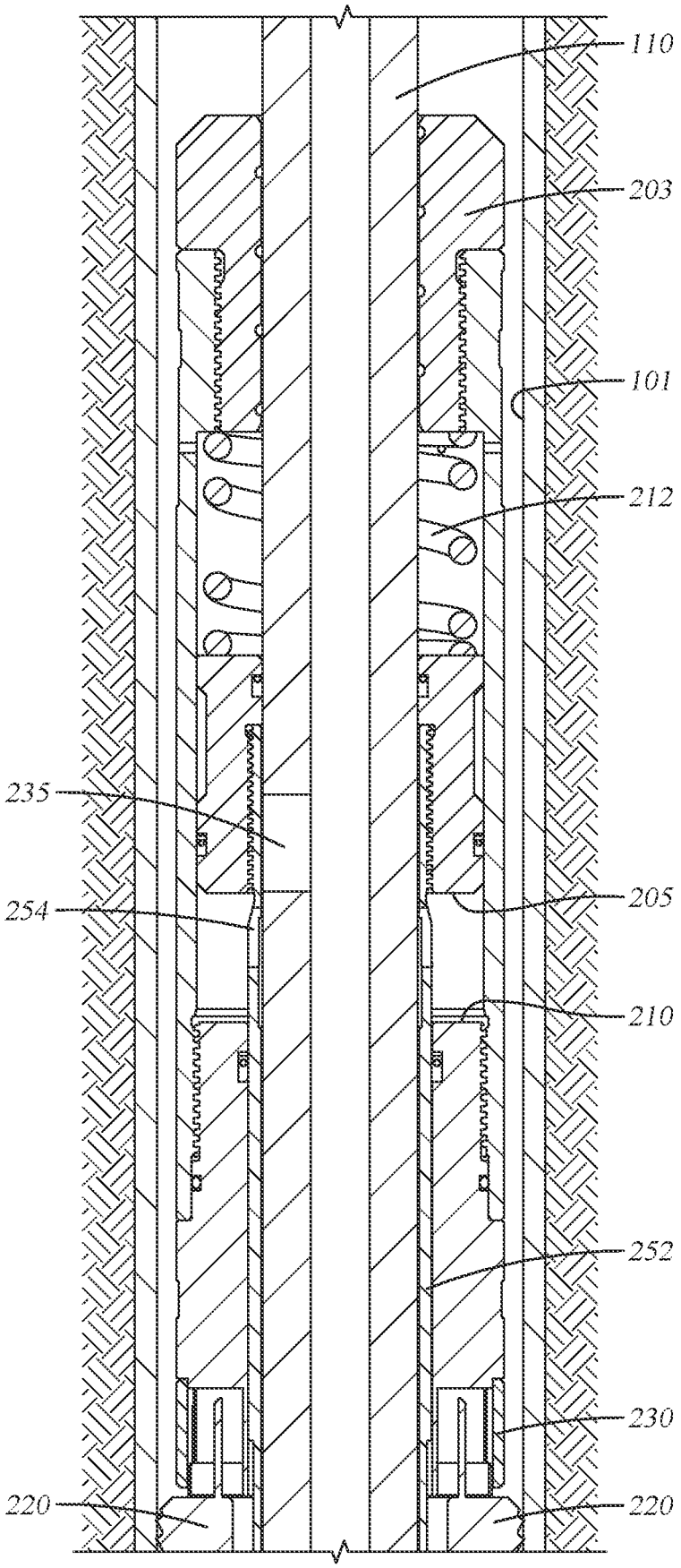
FIGS. 7A-D are section views of the tool showing the packer set in the wellbore.
Figure 7B:
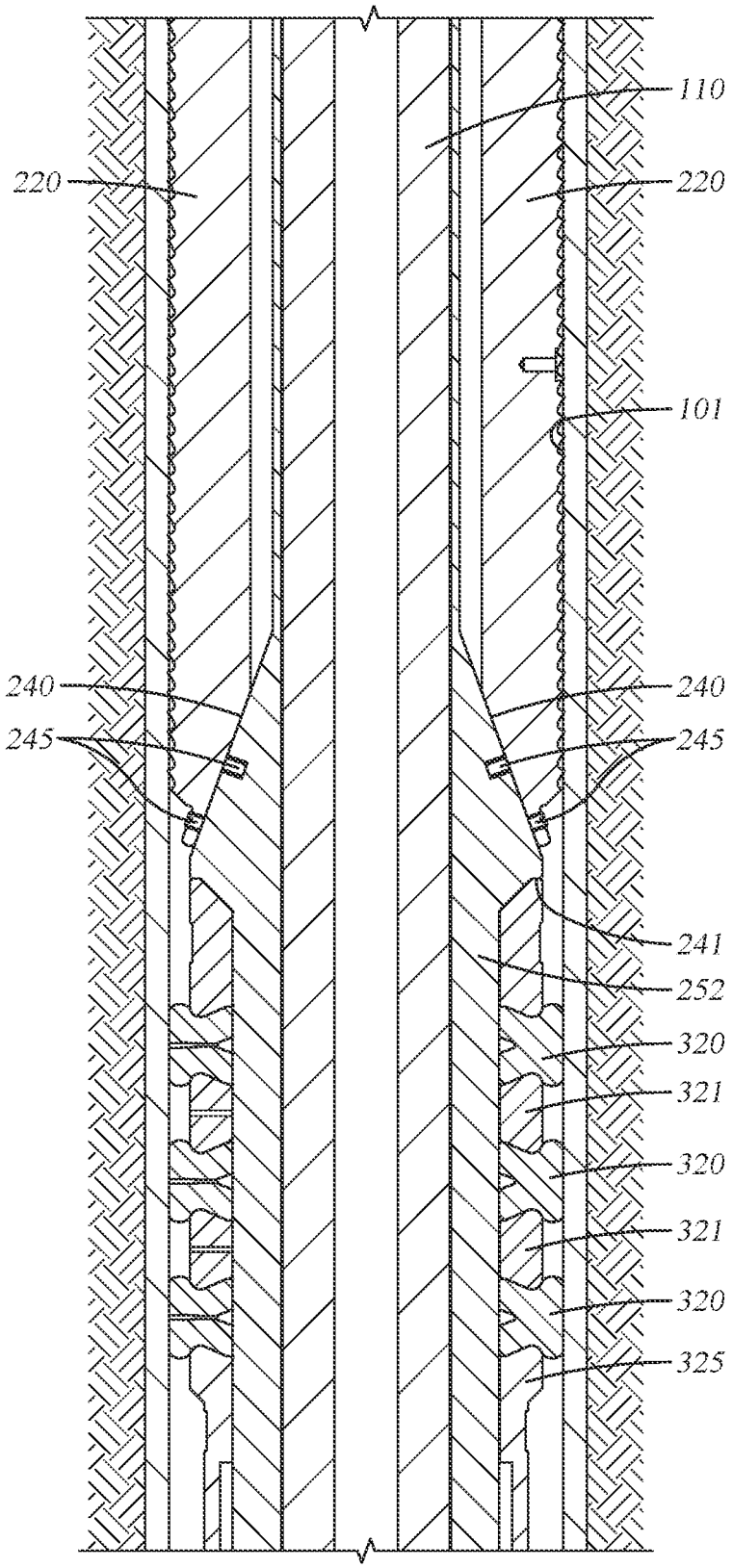
Figure 7C:
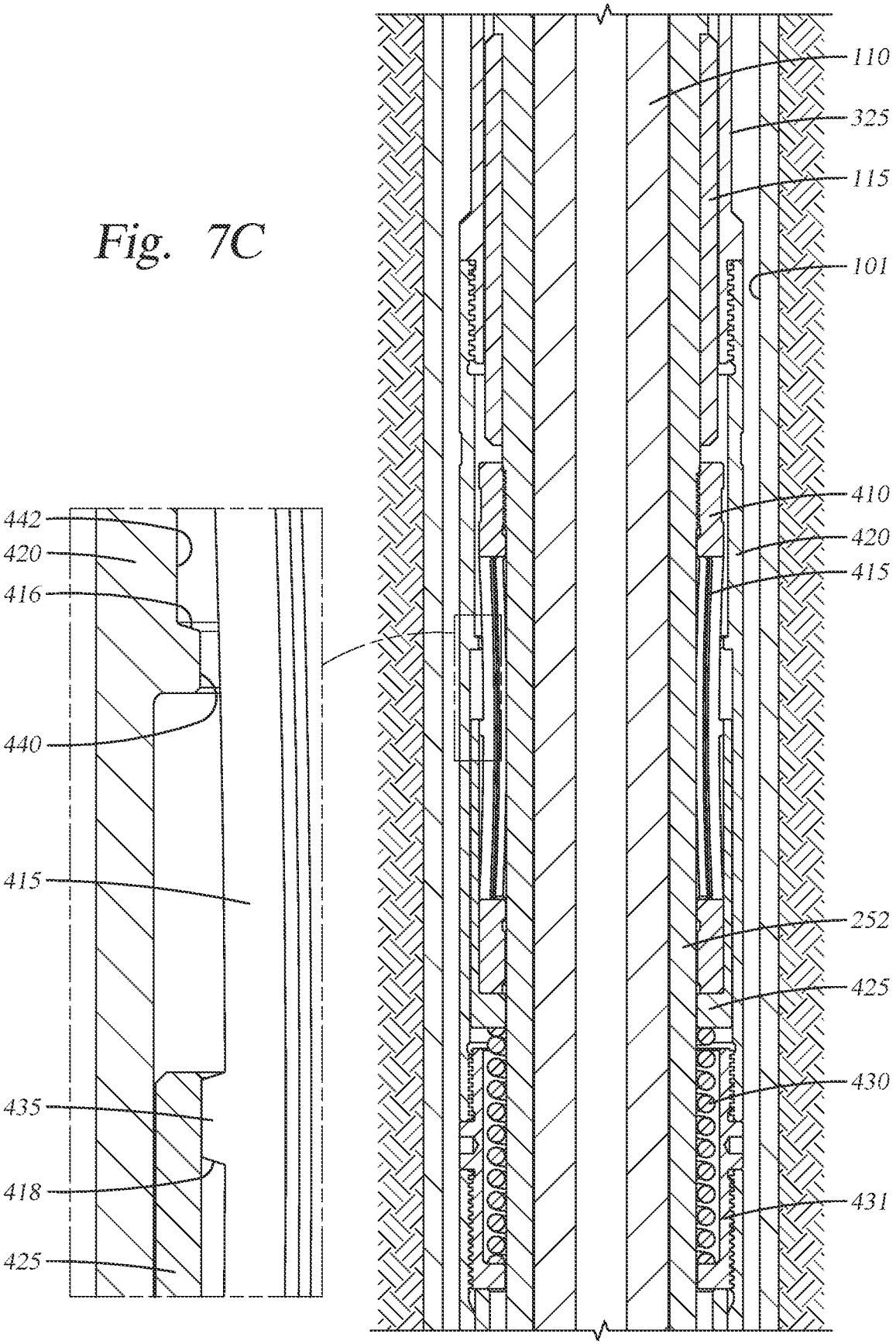

The locking system 400 of the packer 300 prevents its inadvertent actuation. The locking system includes the collet sleeve 410 with its radially disposed fingers 415, all of which must be deflected inwardly in order to unlock the packer and allow it to be set. In FIG. 4C two of the fingers are visible. An enlarged view of the locking system in the area of the fingers 415 is provided on the left side of the Figure. Each finger has an outwardly facing tab 435 that, in the locked positon rests above an inwardly facing upset 440 that extends around an adjacent inner surface 442 of the collet housing 420. The upset 440 can also be appreciated in FIG. 3C. To unlock the packer, it is necessary to move the collet housing upwards in relation to the collet sleeve 410. The position of the upset 440 under the tabs 435 prevents that from happening until enough upwards force is applied to the collet housing to allow an angled surface 416 of the upset 440 to interact with a corresponding angled surface 418 of the fingers and deflect the fingers inwards far enough for the upset to move past the fingers (FIG. 6C). Just below the tabs 435 of the fingers 415 is a spring-loaded sleeve 425 biased upwards by a spring 430 against an underside of the upset. The purpose of the sleeve is to keep the collet fingers in their deflected position as the collet housing 420 moves upwards as the packer elements 320 are compressed from below. In one embodiment, the sleeve 425 is dimensioned whereby the tabs 435 are forced inwards an additional distance as can be appreciated by comparing FIGS. 5C, 6C, and 7C. The purpose of an additional, slight deflection is to facilitate resetting of the locking system whereby two "steps" are created as the tabs move outwards to their original, non-deflected position as shown in 5C.

FIGS. 6A-D are section views showing the tool in the wellbore with the slip assembly 200 set and the locking system 400 of the packer in an unlocked position. As shown clearly in FIG. 6C, the components of the packer assembly 300 and locking system are shown at the instant when the packer is unlocked due to relative movement between the inwardly facing upset 440 of the collet housing 420 and the outwardly facing tabs 435 of the collet fingers 415. As illustrated, the collet fingers have been deflected inwards due to upward force applied to the collet housing 420 which has permitted a sliding action between angles 416, 418 of the upset 440 and tabs 435 of the fingers 415. The tabs of the displaced fingers have come to rest on an upper end of the spring-loaded sleeve 425 in order to keep them deflected and permit the locking system 400 to be re-set if needed.

The force required to deflect the fingers and "unlock" the locking mechanism of the packer assembly 300 is supplied from the surface where, in one embodiment, 70,000 lbs. of upward force is required over and above the upward force already keeping the slip assembly 200 set against the wellbore wall. The upward force on the work string (20; FIG. 8) acts primarily on an enlarged diameter portion 140 of the mandrel 110 visible in FIG. 6D. The enlarged diameter portion serves to urge the movable parts of the lower portion of the assembly, including the collet housing 420 upwards as if they are being pushed, in order to set the packer once the locking system has been unlocked. The distance needed to compress the elements 320 and set the packer is a distance equal to the gap 335 shown between L-shaped member 250 and stop sleeve 336 in FIG. 6D.

Figure 7D:
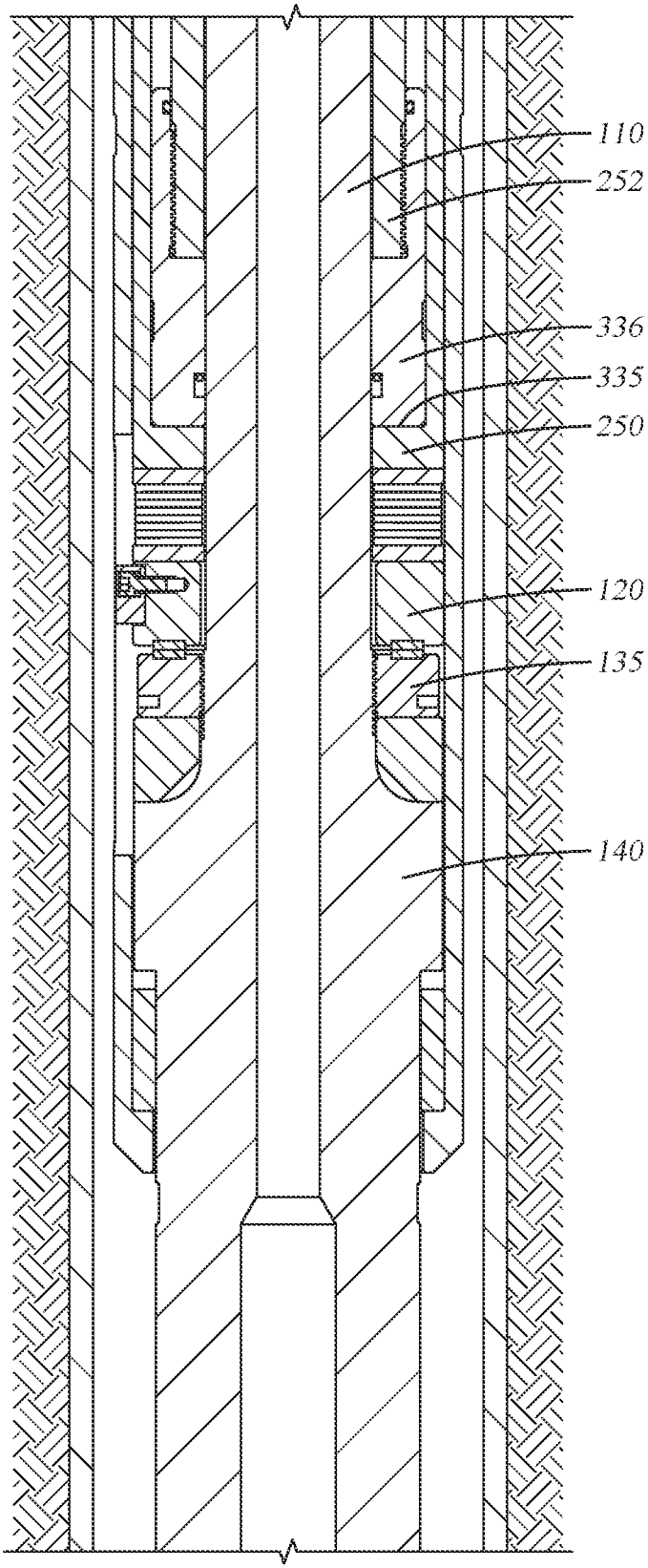

FIGS. 7A-D are section views of the tool showing the packer assembly 200 set in the wellbore 101. As with FIGS. 5A-D and 6A-D, the slip assembly 200 remains set due to upward fore on the mandrel 110 via a work string (20; FIG. 8) from the surface of the well. Comparing the Figures to 6A-D, the upward force applied to unlock the packer assembly has moved the mandrel and its enlarged diameter portion upwards along with the collet housing 420. The result is a movement between the parts equal to the gap 335 shown in FIG. 6D. The portions of the locking system are in essentially the same position as they were in FIGS. 6A-D. However, that part of the assembly associated with the collet housing 420 has moved upwards in relation to the collet sleeve 410 in order to compress the packer elements 320. In FIG. 7D, the gap 335 of FIG. 6D has now been closed, reflecting the distance that the elements 320 have been compressed. As described herein, the locking system 400 of the packer assembly 300 requires a high upward force on the work string (20; FIG. 8) to move the upset 440 of the collet housing 420 against the tabs 435 of the fingers 415 in order to displace the fingers inward and permit upward movement of the housing. Once unlocked, the movement required to actually set the packer and compress the element requires little force and, due the upward force remaining on the string, takes place instantaneously. As shown in FIGS. 7A-D, the packer element has been compressed between the underside 241 of the conical shape 240 and the upward facing shoulder formed at the lower end of the element.

In operation, the assembly of the present invention can be utilized in a number of different ways. In one example as shown in FIG. 8, the tool 100 is used with a cutting tool 30 for separating an upper portion of a casing 12 in the wellbore 101 from a lower portion. Cutting tools for severing tubulars in a wellbore are well known. One example is described in US patent publication number 2018/0258734 assigned to the same assignee as the present invention and that publication is incorporated herein in its entirety. Preferably, the cutting tool 30 has radially extendable cutters (not shown) that extend outwardly at a predetermined time into contact with the walls of the surrounding tubular. Thereafter, the tubing 12 is severed by rotational movement of the cutting tool 30. As described herein, a center portion of the tool 100, including the mandrel (110) is constructed and arranged to be rotatable relying in part on bearing member (135) and various keyed relationships between portions of the tool, like the ring with lugs (120) and slots (130) of sleeve (125).

In one embodiment as shown in FIG. 8, the tool 100 is run into a wellbore 101 on a work string 20 with a cutting tool 30 disposed on the string 20 therebelow. The purpose of the operation is to sever a tubular 12 lining the wellbore 101. The combination of tools 100, 30 is run into a location adjacent the location where the surrounding tubular 12 is to be severed. Thereafter, fluid is pumped through the work string 20 and through port (235) formed in a wall of the mandrel (110). As the fluid acts upon two opposing piston surfaces (205, 210), set screws (245) pinning the slips (220) in a run-in position relative to the conical shape (240) are broken and the slips are moved downwards along the conical member and into contact with the walls of the surrounding tubular 12. Thereafter, an upward force is applied to the work string 20 to keep the slips set in a wedging relationship between the conical shape and the wellbore 101's wall. With the tool combination fixed in a predetermined location in the wellbore 101, the cutting tool 30 is operated by rotating the work string 20 from the surface while upward force is maintained to keep the slips set. Once the cutting tool 30 has successfully severed the tubular 12, the entire assembly (20, 30, 100) including the upper portion of the tubular 12 is lifted using the slips that remain engaged. Due to the weight of the severed tubular 12 being lifted, the packer in most cases will be unlocked and moved to a set positon. However, in this operation having the packer set has no bearing on the result of retrieving the tubular portion to the surface of the well.

In another scenario, the operation is carried out as above but, due to interference by wellbore debris between the tubular 12 lining the wellbore 101 and the borehole therearound, the severed tubular 12 cannot be successfully lifted. In this instance, additional lifting force is applied to the work string 20 from the surface of the well. At about 75,000 lbs. of force, the locking system 400 of the packer assembly 300 is unlocked according to the operations described in relation to the forgoing Figures, especially FIGS. 5C and 6C. Thereafter, fluid is pumped out a lower end of the string, below the cutting tool where it "washes" the area between an outer surface of the tubular and the borehole therearound using the area where the tubular was cut as a fluid path to the outer surface. In this manner, debris such as dirt that can hamper the lifting and separation of the upper portion of the tubular from the lower portion can be disturbed. In some instances, such as shown in FIG. 9, a barrier 40, such as another packer, is set below the cutting tool 30 so that the washing fluid is trapped between the lower packer 40 and the packer of the tool 100, forcing it out of the tubular 12 and into the area of the borehole. In other instances, as shown in FIG. 9, a cement plug previously placed in the wellbore 101 creates the barrier 40 below the tool. In addition to its "washing" function, the fluid pumped between the packers/cement plug can be pressurized and provide additional lifting force. If the operation is successful, the tool 100, cutting tool 30 and upper section of tubular 12 are lifted to the surface with the slip and packer assembly remaining set.

In yet another scenario, the initial lifting is unsuccessful and the washing procedure described above is also unsuccessful in loosening the upper portion of tubular 12 to a point where it can be dislodged and raised. In this case, the entire assembly including the tool 100 and cutting tool 30 can be repositioned at another, typically higher location where the process will be attempted again. In order to reposition the assembly, the slips and packer must first be unset. By reducing lifting force on the work string 20, the locking system 400 of the packer assembly 300 is first re-set as the collet housing 420 with its inwardly facing upset 440 is moved down relative to the collet sleeve 410 with its displaced fingers 415 with their outwardly extending tabs 435. Due to the same angles 416, 418 of the upset 440 and tabs 435, the re-setting of the locking system requires relatively little force compared to the 70,000 lbs. necessary to move them to the unlocked position. Once the packer is returned to its unset position with its locking system re-set, additional downward movement releases the slips and the spring-loaded cap urges the slips to their run-in position. Thereafter, the assembly including the tool 100 and cutting tool 30, or any other tool attached thereto, can be raised to a higher location in the wellbore 101 where the slip assembly 200 will be reset and if needed, the locking system 400 of the packer 300 can be unlocked and the packer set just as it was in the prior attempt.

While the foregoing is directed to embodiments of the present disclosure, other and further embodiments of the disclosure may be devised without departing from the basic scope thereof, and the scope thereof is determined by the claims that follow.

What is claimed is:

1. A method of separating a downhole tubular, the method comprising:

running a tool into a wellbore to a predetermined location on a work string;

actuating flow-actuated slips;

maintaining the flow-actuated slips in a set position by providing a first upward force on the work string;

rotating the work string to separate an upper portion of the tubular from a lower portion using a cutter assembly disposed on the work string below the flow-actuated slips;

maintaining a packer assembly in an unset position on the tool using a locking system in a locked position; and pulling the upper portion of the tubular and the tool from the wellbore.

2. The method of claim 1, wherein the pulling of the upper portion of the tubular and the tool from the wellbore unlocks the packer assembly of the tool.

3. The method of claim 2, wherein the packer assembly is then moved to a second set position in the wellbore.

4. The method of claim 3, wherein the packer assembly is set in the second set position by a second upward force on the work string, the second upward force being greater than the first upward force.

5. The method of claim 1, wherein actuating the flow-actuated slips comprises pumping a working fluid through the work string, wherein a port located in a wall of a mandrel of the tool permits the working fluid to travel between the work string and the flow-actuated slips.

6. The method of claim 1, wherein, in response to pulling the upper portion of the tubular and the tool from the wellbore, the method further comprises:

determining that the upper portion of the tubular cannot be lifted from the wellbore;

unlocking the locking assembly and setting the packer assembly;

clearing debris by flowing fluid through the work string and into an annular area between the tubular and the wellbore therearound; and pulling the upper portion of the tubular and the tool again from the wellbore.

7. The method of claim 6, wherein flowing the fluid through the work string and into the annular area further comprises:

creating a barrier below the tool;

trapping the fluid between the barrier and the packer assembly of the tool; and providing an additional lifting force on the upper portion of the tubular by pumping the fluid pressurized between the barrier and the packer assembly.

8. The method of claim 7, wherein creating the barrier below the tool comprises:

setting a lower packer below the cutting tool to trap the fluid between the lower packer and the packer assembly of the tool; or using a cement plug previously placed in the wellbore to create the barrier below the tool.

9. The method of claim 6, wherein pulling the upper portion of the tubular and the tool again from the wellbore comprises lifting the tool, the cutting tool, and the upper portion of the tubular with the flow-actuated slips and the packer assembly remaining set.

10. The method of claim 6, wherein, in response to pulling the upper portion of the tubular and the tool again from the wellbore, the method further comprises:

determining that the upper portion of the tubular cannot be dislodged and raised; and repositioning the tool and the cutting tool at another location on the tubular to separate another upper portion of the tubular.

11. The method of claim 10, wherein repositioning the tool and the cutting tool comprises:

unsetting the flow-actuated slips and the packer assembly by reducing a lifting force on the work string;

resetting the locking system of the packer assembly;

returning the packer assembly to the unset position with the locking system reset; and releasing the flow-actuated slips and urging the flow-actuated slips to a run-in position by applying additional downward movement.

12. The method of claim 11, wherein after repositioning, the method comprises resetting the flow-actuated slips, unlocking the locking system of the packer assembly, and setting the packer assembly.

13. The method of claim 6, wherein pulling the upper portion of the tubular and the tool from the wellbore comprises:

applying a second upward force on the work string to unlock and set the packer assembly, the second upward force being greater than the first upward force;

flowing fluid through the work string and into an annular area between tubular and the wellbore therearound, the annular area accessible through a cut formed between the upper and lower portions by the cutter assembly;

reducing the second upward force on the work string to unset and re-lock the packer assembly; and pulling the upper portion of the tubular from the wellbore.

14. The method of claim 6, wherein maintaining the packer assembly in the unset position on the tool using the locking system in the locked position comprises preventing axial movement between displaceable members of a collet sleeve having a collet housing disposed therearound; and wherein unlocking the locking assembly comprises moving the locking system from the locked position to an unlocked position in which axial movement between the displaceable members is permitted and in which the displaceable members of the collet sleeve are displaced.

15. The method of claim 14, wherein the displaceable members each include a tab formed on an outer surface thereof, each tab including a lower tab angle; and wherein the collet housing includes an upset formed on an inner surface thereof, the upset including an upper angled surface constructed and arranged to matingly contact the lower tab angles of the displaceable members in the locked position.

16. The method of claim 15, wherein moving the locking system from the locked position to the unlocked position comprises applying enough upward movement of the collet housing relative to the collet sleeve for the upper angled surface of the upset to move past the lower tab angles, thereby deflecting the displaceable members inwards a first distance and permitting axial movement between the collet sleeve and the collet housing.

17. The method of claim 15, wherein after the system is unlocked, the displaceable members are deflected a second additional distance.

18. The method of claim 17, wherein movement from the locked to the unlocked position requires a first higher force and movement from the unlocked to the locked position requires a second lesser force.

19. A method of separating a downhole tubular, the method comprising:

running a tool into a wellbore to a predetermined location on a work string;

actuating flow-actuated slips;

maintaining the flow-actuated slips in a set position by providing a first upward force on the work string;

rotating the work string to separate an upper portion of the tubular from a lower portion using a cutter assembly disposed on the work string below the flow-actuated slips;

applying a second upward force on the work string to unlock and set a packer, the second upward force being greater than the first upward force;

flowing fluid through the work string and into an annular area between the tubular and a borehole therearound, the annular area accessible through a cut formed between the upper and lower portions by the cutter assembly;

reducing the second upward force on the work string to unset and re-lock the packer; and pulling the upper portion of the tubular from the wellbore.

20. The method of claim 19, wherein the flow-actuated slips are actuated by pumping a working fluid through the work string, wherein a port located in a wall of a mandrel of the tool permits the working fluid to travel between the work string and the flow-actuated slips.

21. A locking system for a downhole tool, the locking system comprising:

a first portion including a collet sleeve having a plurality of displaceable members, a second portion disposed around the first portion, the second portion including a collet housing; a locked position wherein axial movement between the members is prevented; and an unlocked position wherein axial movement between the members is permitted and wherein the displaceable members of the collet sleeve are displaced in the unlocked position, the displaceable members each including a tab formed on an outer surface thereof, each tab including a lower tab angle and the collet housing including an upset formed on an inner surface thereof, the upset including an upper angled surface constructed and arranged to matingly contact the lower tab angles of the displaceable members in the locked position.

22. The locking system of claim 21, wherein moving the system from the locked to the unlocked position requires enough upward movement of the second portion relative to the first position for the upper angled surface of the upset to move past the lower tab angles, thereby deflecting the displaceable members inwards a first distance and permitting axial movement between the sleeve and the housing.

23. The locking system of claim 22, wherein after the system is unlocked, the displaceable members are deflected a second additional distance.

24. The locking system of claim 23, wherein movement from the locked to the unlocked position requires a first higher force and movement from the unlocked to the locked position requires a second lesser force.

* * * * *